US008127844B2

(12) United States Patent
Luharuka et al.

(10) Patent No.: US 8,127,844 B2
(45) Date of Patent: Mar. 6, 2012

(54) METHOD FOR OILFIELD MATERIAL DELIVERY

(75) Inventors: Rajesh Luharuka, Stafford, TX (US); Rod Shampine, Houston, TX (US); Jean-Louis Pessin, Cailloux (FR); Philippe Gambier, Houston, TX (US); Joe Hubenschmidt, Sugar Land, TX (US); John Lassek, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 263 days.

(21) Appl. No.: 12/415,169

(22) Filed: Mar. 31, 2009

(65) Prior Publication Data

US 2010/0243255 A1 Sep. 30, 2010

(51) Int. Cl.
*E21B 21/06* (2006.01)

(52) U.S. Cl. ..... 166/275; 166/75.15; 175/206

(58) Field of Classification Search ..... 166/275, 166/305.1, 75.11, 90.1, 75.15; 175/206
See application file for complete search history.

(56) References Cited

U.S. PATENT DOCUMENTS

| | | | | |
|---|---|---|---|---|
| 3,560,053 | A | 2/1971 | Ortloff | |
| 4,029,362 | A | 6/1977 | Kortenbusch | |
| 4,371,294 | A | 2/1983 | Sakamoto | |
| 4,614,435 | A | 9/1986 | McIntire | |
| 4,671,665 | A | 6/1987 | McIntire | |
| 4,808,004 | A | 2/1989 | McIntire et al. | |
| 5,624,058 | A * | 4/1997 | Bailey | 222/240 |
| 5,775,852 | A | 7/1998 | Boutte et al. | |
| 5,799,734 | A * | 9/1998 | Norman et al. | 166/278 |
| 5,899,272 | A | 5/1999 | Loree | |
| 6,056,058 | A | 5/2000 | Gonzalez | |
| 6,119,779 | A * | 9/2000 | Gipson et al. | 166/267 |
| 6,776,235 | B1 | 8/2004 | England | |
| 7,195,084 | B2 * | 3/2007 | Burnett et al. | 175/66 |
| 7,451,812 | B2 | 11/2008 | Cooper et al. | |
| 2005/0006089 | A1 | 1/2005 | Justus et al. | |
| 2005/0056428 | A1 | 3/2005 | Jeffrey, Jr. | |
| 2005/0058020 | A1 * | 3/2005 | Lott | 366/348 |
| 2006/0289166 | A1 | 12/2006 | Stromquist et al. | |
| 2008/0066911 | A1 | 3/2008 | Luharuka et al. | |
| 2010/0243252 | A1 * | 9/2010 | Luharuka et al. | 166/283 |

FOREIGN PATENT DOCUMENTS

| | | |
|---|---|---|
| AU | 2007201182 A1 | 10/2008 |
| EP | 0776843 | 6/1997 |
| GB | 816013 | 7/1959 |

* cited by examiner

*Primary Examiner* — Daniel P Stephenson
*Assistant Examiner* — Catherine Loikith
(74) *Attorney, Agent, or Firm* — Myron K. Stout; Michael M. Dae; Michael Flynn

(57) ABSTRACT

In an embodiment, a method of operating at least one pressure vessel to inject a particulate slurry into a high-pressure line, comprises a first operating cycle comprising: isolating the at least one pressure vessel from the high-pressure line; introducing particulate solids into the pressure vessel through a particulate solids inlet aperture; a second operating cycle comprising: providing high-pressure flow into the pressure vessel; and providing a high-pressure slurry flow from the pressure vessel into the high-pressure line. The method further comprises operating the at least one pressure vessel in the second operating cycle to create a heterogeneous flow of slurry into the high-pressure line.

21 Claims, 15 Drawing Sheets

METHOD FOR OILFIELD MATERIAL DELIVERY

FIELD

The statements in this section merely provide background information related to the present disclosure and may not constitute prior art. Embodiments of the disclosed apparatus and method relate generally to systems and methods for delivering an oilfield material to a well at an oilfield.

BACKGROUND

The statements in this section merely provide background information related to the present disclosure and may not constitute prior art.

Production of oil and gas from subterranean formations presents a myriad of challenges. One such challenge is the lack of permeability in certain formations. Often oil or gas bearing formations, that may contain large quantities of oil or gas, do not produce at a desirable production rate due to low permeability; the low permeability causing a poor flow rate of the sought-after hydrocarbons. To increase the flow rate, a stimulation treatment can be performed. Once such stimulation treatment is hydraulic fracturing. Hydraulic fracturing is a process whereby a subterranean hydrocarbon reservoir is stimulated to increase the permeability of the formation, increasing the flow of hydrocarbons from the reservoir. A fracturing fluid is pumped at very high pressure, e.g., in excess of 10,000 psi, to crack the formation thereby creating larger passageways for hydrocarbon flow.

While the high pressure introduced may produce cracks in a formation, the removal of the pressure back to normal borehole pressures, often cause the closing of the cracks much in the manner that a crack wedged open in a piece of wood may close when the wedge used to produce the crack is removed. Such closing of the reservoir cracks produced by the hydraulic fracturing operating is very undesirable.

To avoid the closing of reservoir cracks when the hydraulic pressure is lowered, the fracturing fluid may have proppants added thereto, such as sand or other solids that fill the cracks in the formation, so that, at the conclusion of the fracturing treatment, when the high pressure is released, the cracks remain propped open, thereby permitting the increased hydrocarbon flow possible through the produced cracks to continue into the wellbore.

In order to pump the fracturing fluid into the well, large oilfield operations generally employ any variety of positive displacement or other fluid delivering pumps.

A positive displacement pump may be a fairly large piece of equipment with associated engine, transmission, crankshaft and other parts, operating at between 200 Hp and about 4,000 Hp. A large plunger is driven by the crankshaft toward and away from a chamber in the pump to dramatically affect a high or low pressure thereat. This makes a positive displacement pump a good choice for high pressure applications. Hydraulic fracturing of underground rock, for example, often occurs at pressures between 10,000 to 20,000 PSI or more.

When employing oilfield pumps, regular pump monitoring and maintenance may be sought to help ensure uptime and increase efficiency of operations. A pump, as with any form of industrial equipment, is susceptible to natural wear that could affect uptime or efficiency. This may be of considerable significance in the case of pumps for large-scale oilfield operations as they are often employed at the production site and operated at a near round the clock basis and may operate under considerably harsh protocols. For instance, in the case of hydraulic fracturing applications, a positive displacement pump may be employed at the production site and intended to operate for six to twelve hours per day for more than a week generating extremely high pressures. Thus, wear on pump components during such operation may present in a variety of forms.

Abrasive wear occurs when the particles within the fluid impact on the exposed surfaces of the machinery and impart some of their kinetic energy into the exposed surface. If sufficiently high, the kinetic energy of the impacting particles creates significant tensile residual stress in the exposed surface, below the area of impact. Repeated impacts cause the accumulation of tensile stress in the bulk material that can leave the exposed surface brittle and lead to cracking, crack linkage and gross material loss.

In particular, internal valve seals of the pump are prone to failure, especially where abrasive oilfield material is directed through the pump during a fracturing application. These internal valve seals may be of a conformable material in order to allow proper sealing. However, the conformable nature of the seal may leave it susceptible to deterioration by abrasive oilfield materials that are pumped through the valves. Additionally, other components of the pump may be susceptible to wear by abrasives that are pumped through the pump. Such deterioration of pump components may considerably compromise control over the output of the pump and ultimately even render the pump ineffective.

Efforts have been made to actually prevent pump damage by pumped abrasives. These efforts include introducing abrasives, such as proppants, at locations subsequent to the pressure producing valves and other particularly susceptible oilfield pump components. For example, as detailed in U.S. Pat. No. 3,560,053 to Ortloff, a pressurized abrasive slurry may be introduced to an oilfield fluid after the fluid has been directed from an oilfield pump. In this manner, the oilfield pump may be spared exposure to the potentially damaging abrasive slurry.

Unfortunately, the method described above, is achieved by the addition of a significant amount of equipment at the oilfield. Often this equipment may require its own monitoring and maintenance due to exposure to the abrasive slurry. For example, mixing and blending equipment along with pressurization equipment, including susceptible valving, may be required apart from the primary oilfield pumps described above. Thus, while the original pumps may be spared exposure to abrasives, another set of sophisticated equipment remains exposed.

Because the fracturing fluid is pumped at extremely high pressure, the proppants included in the fracturing fluid can be coated in order to increase their durability and use under high-pressure conditions and to minimize proppant flow back from propped hydraulic fractured oil and gas wells. The coating of proppants is well known in the state of the art. In U.S. Pat. No. 5,597,784 to Sinclair et al, a method is disclosed for coating the proppant in a resin. Proppants are typically coated in a factory or at a location remote to the well site and transported to the well site after coating has been applied.

Transporting the coated proppant to the well site means that the choices for materials with which the proppant can be coated are limited to those types of coatings that will not sustain damaged in the shipping process. Also, when the proppant is received at the well site and pumped through the high-pressure pumps, the proppant is at risk to become damaged within the processing equipment.

In addition to coatings, stimulation fluid is often augmented with other additives to aid in the stimulation or propping operations. Such additives include lubricants, viscosity breakers, friction reducing agents, cross-link delaying agents, fiber, explosive chemicals, bonding agents, and adhesives. It is desirable that these additives are mixed with the proppant prior to introduction into the high-pressure flow of a hydraulic stimulation treatment.

From the foregoing it will be apparent that there remains a need for a system of pumping abrasive slurry that does not impact the wear and tear of an oilfield pump or pump components.

From the foregoing it will be apparent that there remains a need for a proppant coating mechanism that offers improved process control over the proppant coating process. Furthermore, from the foregoing it will be apparent that it would be desirable to provide a mechanism for introducing proppant and related additives as a mixture without requiring pumping of such a mixture through the high-pressure pumps used to produce the hydraulic pressure used to stimulate hydrocarbon reservoirs.

SUMMARY

An oilfield material delivery mechanism and method of operation thereof is disclosed. The mechanism provides a highly efficient approach for introducing harsh materials into a high-pressure fluid flow while avoiding pumping the oilfield material through pumping equipment that is susceptible to abrasive wear from such materials. The mechanism includes a particulate solids reservoir and a pressure vessel. The pressure vessel includes a first liquid inlet in fluid communication with a first high-pressure line and comprising a first valve, a particulate solids inlet aperture connected to the particulate solids reservoir and located substantially in an upper portion of the pressure vessel and comprising a second valve operable to selectively isolate the pressure vessel from the particulate solids reservoir, and a first outlet in fluid communication with a second high-pressure line and comprising a third valve.

The oilfield material delivery mechanism may be operated to introduce a particulate slurry into a high-pressure line by isolating the pressure vessel from the high-pressure line, introducing, under low-pressure conditions, particulate solids into the pressure vessel through a particulate solids inlet aperture, providing high-pressure clean-fluid flow into the pressure vessel, and discharging high-pressure slurry flow from the pressure vessel into the high-pressure line.

In an embodiment, a method of operating at least one pressure vessel to inject a particulate slurry into a high-pressure line, comprises a first operating cycle comprising: isolating the at least one pressure vessel from the high-pressure line; introducing particulate solids into the pressure vessel through a particulate solids inlet aperture; a second operating cycle comprising: providing high-pressure flow into the pressure vessel; and providing a high-pressure slurry flow from the pressure vessel into the high-pressure line. The method further comprises operating the at least one pressure vessel in the second operating cycle to create a heterogeneous flow of slurry into the high-pressure line. Alternatively, operating comprises alternately operating the at least one pressure vessel in the first operating cycle and the second operating cycle. Alternatively, the fluid in the high pressure line and the high pressure slurry flow comprise contrasting properties. Alternatively, the particulate slurry comprises at least one of a proppant, a proppant coating, and fill material. Alternatively, the high pressure line comprises substantially clean treatment fluid. Alternatively, the at least one pressure vessel comprises at least two pressure vessels. The method may further comprise causing one pressure vessel to operate in the first operating cycle while operating the other pressure vessel in the second operating cycle. The method may further comprise switching a first pressure vessel from the first operating cycle to the second operating cycle and switching a second pressure vessel from the second operating cycle to the first operating cycle, and synchronizing the switching in a manner such the at least two pressure vessels are operating in the second operating cycle simultaneously. The at least two pressure vessels may be at least four pressure vessels organized in at least two phased pairs wherein at least one pair of pressure vessels switch between first and second operating cycles at a time that is different from when at least one other pair switch between first and second operating cycles. Alternatively, the second operating cycle further comprises equalizing the pressure of the pressure vessel and the high-pressure line by increasing the pressure in the pressure vessel prior to providing high-pressure clean-fluid flow into the pressure vessel.

In an embodiment, a method of operating at least one pressure vessel to inject a particulate slurry into a high-pressure line, the high pressure line comprising substantially clean treatment fluid, comprises a first operating cycle comprising: isolating the at least one pressure vessel from the high-pressure line; introducing, under low-pressure conditions, particulate solids into the pressure vessel through a particulate solids inlet aperture; a second operating cycle comprising: providing high-pressure flow into the pressure vessel; and providing a high-pressure slurry flow from the pressure vessel into the high-pressure line. The method further comprises operating the at least one pressure vessel in the second operating cycle for a predetermined time interval to create heterogeneous flow of slurry into the high-pressure line.

Alternatively, the predetermined time interval comprises operating the at least one pressure vessel in the second operating cycle for a predetermined duration of time. The predetermined duration may comprise from about one second to about two minutes. Alternatively, the method further comprises stopping the second operating cycle for a second predetermined duration of time. The second predetermined duration of time may comprises from about one second to about two minutes. The first predetermined time interval may comprise from about one second to about two minutes and the second predetermined time interval may comprise from about one second to about two minutes. The high pressure line may supply treatment fluid to the wellbore during the second predetermined time interval.

Alternatively, the predetermined time interval comprises operating the at least one pressure vessel in the second operating cycle for a first predetermined duration of time and operating the at least one pressure vessel in the first operating cycle for a second predetermined duration of time. Alternatively, operating comprises operating the at least one pressure vessel to produce slurry at the predetermined time intervals of a predetermined density in the high pressure line. The predetermined density may be about 0.1 pounds of proppant per gallon to about 16.0 pounds of proppant per gallon. Alternatively, the second operating cycle comprises causing the pressure of the pressure vessel to slightly exceed the pressure of the high-pressure line thereby producing the high-pressure slurry flow from the pressure vessel into the high-pressure line.

In an embodiment, a method of fracturing a subterranean formation penetrated by a wellbore utilizing at least one pressure vessel to inject a particulate slurry into a high-pressure line, the high pressure line comprising substantially clean treatment fluid, comprises isolating the at least one pressure vessel from the high-pressure line; introducing, under low-pressure conditions, particulate solids into the pressure vessel through a particulate solids inlet aperture to form the slurry, the slurry having a predetermined property different than a property of the treatment fluid; providing high-pressure flow into the pressure vessel; providing a high-pressure slurry flow from the pressure vessel into the high-pressure line to inject the slurry into the high pressure line at a predetermined time interval to create heterogeneous flow of slurry into the high-pressure line; and routing the high pressure line to the wellbore to perform a fracturing job in the wellbore.

In an embodiment, a method of operating at least two pressure vessels to inject a particulate slurry into a high-pressure line, comprises a first operating cycle comprising: isolating a pressure vessel from the high-pressure line, introducing, under low-pressure conditions, particulate solids into the pressure vessel through a particulate solids inlet aperture, a second operating cycle comprising: providing high-pressure flow into the pressure vessel, and providing a high-pressure slurry flow from the pressure vessel into the high-pressure line. The method further comprises causing the at least one pressure vessel to operate in the first operating cycle while operating at least one pressure vessel in the second operating cycle, and synchronizing switching a first pressure vessel from the first operating to a second operating cycle and switching a second pressure vessel from the second operating cycle to the first operating cycle in a manner such that at least one of the at least two pressure vessels is operating in the second operating cycle at any one time. Alternatively, the method further comprises switching a first pressure vessel from the first operating cycle to the second operating cycle and switching a second pressure vessel from the second operating cycle to the first operating cycle, and synchronizing the switching in a manner such the at least two pressure vessels are operating in the second operating cycle simultaneously. Alternatively, the at least two pressure vessels is at least four pressure vessels organized as independent pairs. The at least two pressure vessels may be at least four pressure vessels organized in at least two phased pairs wherein at least one pair of pressure vessels switch between first and second operating cycles at a time that is different from when at least one other pair switch between first and second operating cycles. Alternatively, the at least two pressure vessels is at least three pressure vessels (sequentially numbered 1 through n wherein n is the total number of pressure vessels) and wherein synchronizing comprises cycling the pressure vessels such that when pressure vessel $_{i \bmod n+2}$ transitions from the second operating cycle to the first operating cycle and pressure vessel $_{i \bmod n+1}$ transitions from the first operating cycle to the second operating cycle. Alternatively, the first operating cycle further comprises returning overflow of fluid created by introduction of particulate solids from the pressure vessel to a clean fluids reservoir.

Alternatively, providing comprises diverting clean fluid from the high-pressure line upstream from a location at which the high-pressure slurry flow from the pressure vessel is introduced into the high-pressure line. Alternatively, the second operating cycle further comprises: equalizing the pressure of the pressure vessel and the high-pressure line by increasing the pressure in the pressure vessel prior to providing high-pressure clean-fluid flow into the pressure vessel. Equalizing may comprise operating a pressure multiplier device connected to the pressure vessel. Alternatively, introducing comprises allowing the particulate solids to fall under gravity from a particulate solids reservoir into the pressure vessel. Introducing may further comprise metering the particulate solids introduced into the pressure vessel through a feeder valve. Alternatively, the first operating cycle further comprises feeding the particulate solids into the pressure vessel by rotating a feed screw located inside the pressure vessel. Alternatively, the first operating cycle further comprises: mixing the particulate solids with clean fluid prior to introducing the particulate solids into the pressure vessel and introducing comprises pumping the mixture of particulate solids and clean fluid into the pressure vessel using a low-pressure pump. Alternatively, the second operating cycle comprises: causing the pressure of the pressure vessel to slightly exceed the pressure of the high-pressure line thereby producing the high-pressure slurry flow from the pressure vessel into the high-pressure line.

Alternatively, the high-pressure clean-fluid flow is introduced into the pressure vessel in a location substantially near the top of the pressure vessel. Alternatively, the method further comprises depressurizing the pressure vessel and a line carrying overflow from the pressure vessel to the clean fluids reservoir by decreasing the pressure in the pressure vessel prior to opening a valve permitting overflow clean-fluid flow out of the pressure vessel. Depressurizing may comprise operating a pressure reducing device connected to the pressure vessel to decrease the pressure in the pressure vessel. Alternatively, the method further comprises suctioning out fluid from the pressure vessel to a clean fluids reservoir prior to introducing particulate solids into the pressure vessel. Alternatively, introducing further comprises isolating the pressure vessel from a particulate solids reservoir located above the pressure vessel using a check valve. Alternatively, the pressure vessel comprises at least one tubular pipe oriented in a manner not allowing gravity transfer of solids from the inlet aperture to an outlet aperture connected to the high-pressure line. Alternatively, the method further comprises causing the pressure of the pressure vessel to exceed the pressure of the high-pressure line sufficiently to divert a substantial portion of the flow of the high-pressure line flow through the pressure vessel thereby producing the high-pressure slurry flow from the pressure vessel into the high-pressure line.

In an embodiment, an apparatus for mixing and delivering a material to a high pressure flow of fluid, comprises a particulate solids reservoir; and a pressure vessel comprising: a first liquid inlet in fluid communication with a first high-pressure line and comprising a first valve; a particulate solids inlet aperture connected to the particulate solids reservoir and located substantially in an upper portion of the pressure vessel and comprising a second valve operable to selectively isolate the pressure vessel from the particulate solids reservoir; and a first outlet in fluid communication with a second high-pressure line and comprising a third valve. Alternatively, the particulate solids reservoir is one of a funnel, a silo, and a hopper. Alternatively, the second valve located between the pressure vessel and the particulate solids reservoir is a high-pressure valve operable to selectively provide a path through which particulate solids may enter into the pressure vessel.

Alternatively, the apparatus further comprises a feeder valve located below an exit aperture at the bottom of the particulate solids reservoir by which the particulate solids may be metered when introduced into the pressure vessel. The second valve may be connected between the pressure vessel and the particulate solids reservoir is a check valve and wherein the pressure vessel comprises a valve seat on the interior surface of the pressure vessel and located at the particulate solids inlet aperture whereby a positive pressure differential between the interior of the pressure vessel and the particulate solids reservoir causes a valve disk of the valve to seat against the valve seat. The second valve may be connected between the pressure vessel and the particulate solids reservoir comprises a linear actuator connected to the valve disk whereby a displacement of the linear actuator opens the valve to permit flow of particulate solids for the particulate solids reservoir into the pressure vessel. Alternatively, the third valve connected between the pressure vessel and second high-pressure line comprises a spring loaded check valve and where the exterior of the pressure vessel comprises a valve seat located at the first outlet whereby a positive pressure differential between the interior of the pressure vessel and the second high-pressure line causes the third valve to open and wherein the spring causes a valve disk of the third valve to seat against the valve seat when the pressure in the pressure vessel is substantially equal or less than the pressure of the second high-pressure line. Alternatively, the third valve connected between the pressure vessel and second high-pressure line comprises a linear actuator operable to selectively open and close the valve; and where the exterior of the pressure vessel comprises a valve seat located at the first outlet whereby a negative pressure differential between the interior of the pressure vessel and the second high-pressure line causes a valve disk of the third valve to seat against the valve seat and wherein the linear actuator may cause the valve disk of the third valve to move away from the valve seat thereby opening the third valve.

Alternatively, the first high-pressure line is connected to the second-high pressure line upstream of a choke, the choke disposed between the first high-pressure line and the first outlet, wherein the choke is operable to reduce the pressure of the second high-pressure line above the pressure of the first high-pressure line. Alternatively, the apparatus further comprises an overflow outlet located in an upper portion of the pressure vessel thereby providing a mechanism for removing fluid within the pressure vessel displaced by particulate solids introduced into the pressure vessel. Alternatively, the apparatus further comprises an overflow line connected between the first outlet and the third valve, and via a side connection on the connection between the first outlet and third valve, to a suction pump connected to a clean fluids reservoir whereby a portion of the fluid in the pressure vessel may be suctioned out of the pressure vessel by the suction pump into the clean fluids reservoir prior to introduction of particular solids into the pressure vessel thereby avoiding an overflow condition. Alternatively, the pressure vessel further comprises a cylindrical wall comprising the first liquid inlet and the overflow outlet integrated into the cylindrical wall. Alternatively, the pressure vessel is a long horizontally oriented tubular vessel. The apparatus may further comprise an internal feed screw operable to transport the particulate solids from a location near the particulate solids inlet to a location near the first outlet. Alternatively, the pressure vessel is a long horizontally oriented pressure pipe wherein the particulate solids reservoir further comprises a clean fluid inlet and wherein the apparatus further comprises a low-pressure slurry pump connected between the particulate solids reservoir and the pressure vessel and operable to pump a slurry produced in the particulate solids reservoir into the pressure vessel.

In an embodiment, an apparatus for mixing and delivering a material to a high pressure flow of fluid, comprises a pressure vessel comprising: a particulate solids inlet aperture located substantially in an upper portion of the pressure vessel; a first liquid inlet in fluid communication with a first high pressure line and the pressure vessel and comprising a first valve; and a first outlet in fluid communication with the pressure vessel and a second high pressure line and comprising a third valve. Alternatively, the apparatus further comprises a second liquid inlet in fluid communication with at least one additive source and the pressure vessel and comprising a second valve. Alternatively, the apparatus further comprises a particulate solids reservoir connected to the particulate solids inlet aperture. The particulate solids reservoir may be one of a funnel, a silo, and a hopper. The apparatus may further comprise a valve connected between the pressure vessel and the particulate solids reservoir and operable to control flow of particulate solids from the particulate solids reservoir to the pressure vessel. Alternatively, the apparatus further comprising a first pumping equipment connected to the first liquid inlet and capable of inducing a pressure exceeding the pressure of the high-pressure line. Alternatively, the first high-pressure line is connected to the second-high-pressure line upstream of a choke, the choke disposed between the first high pressure line and the first outlet, wherein the choke is operable to reduce the pressure of the second high-pressure line below the pressure of the first high-pressure line.

Alternatively, the apparatus further comprises an additive carrying line connected to at least one additive source and to the second liquid inlet. The additive source may be a source containing an additive selected from the group including proppant coating, viscosity breakers, friction reducing agents, cross-link delaying agents, lubricants, fiber, explosive chemicals, bonding agents, adhesives, clean frac fluid, a scale inhibitor, and combinations thereof. Alternatively, the third valve is a one-way valve operable to isolate the pressure vessel from the second high-pressure line and to selectively enable flow from the pressure vessel to the second high-pressure line. Alternatively, the apparatus further comprises a pumping apparatus connected to the second high-pressure line upstream of the first liquid inlet. Alternatively, the pressure vessel is a tubular vessel. Alternatively, the apparatus further comprises a second outlet having a fourth valve and in fluid communication with the pressure vessel in the upper portion of the pressure vessel. The second outlet may be connected to an overflow destination. Alternatively, the pressure vessel is a horizontally oriented tubular vessel and may further comprise an internal feed screw operable to transport the particulate solids from a location near the particulate solids inlet to a location near the first outlet. Alternatively, the pressure vessel comprises at least two pressure vessels connected to the main high-pressure line down-stream from the high-pressure pumping mechanism. The apparatus may further comprise pumping equipment connected to the at least two pressure vessels and capable of selectively inducing a pressure exceeding the pressure of the high-pressure line into the at least two pressure vessels. The pressure vessels may be connected to separate additive sources.

In an embodiment, a method for mixing and delivering a material to a high pressure flow of fluid comprises introducing a particulate solid into a mixing apparatus; introducing a liquid additive into the mixing apparatus and thereby mix the solid and liquid additive; increasing the pressure of the mixing apparatus to a pressure exceeding the pressure of a high-pressure line; and opening a valve between the mixing apparatus and the high-pressure line to release the particulate solid and the liquid additive into the high-pressure line. Alternatively, increasing comprises closing valves on lines for introducing the particulate solid and for introducing the liquid additive and introducing a fluid, that is substantially the same as fluid present in the high-pressure line, into the mixing apparatus. Alternatively, increasing further comprises diverting flow from the high-pressure line to a pressure increasing device; operating the pressure decreasing device to decrease the pressure of the high-pressure line such that at a point downstream from the diversion the pressure in the high-pressure line is lower than the pressure in the diverted flow; and directing the diverted flow into the mixing apparatus. Alternatively, introducing comprises increasing the pressure in a line carrying the liquid additive to the mixing apparatus to a pressure exceeding the pressure of the high-pressure line. Alternatively, the liquid additive is an additive selected from the group including proppant coating, viscosity breakers, friction reducing agents, cross-link delaying agents, lubricants, fiber, explosive chemicals, bonding agents, adhesives, clean frac fluid, and combinations thereof. Alternatively, the method further comprises opening a valve to divert overflow created by the introduction of particulate solid or liquid additive into an overflow destination.

In an embodiment, a method of adding an additive to a proppant flow on the high-pressure side of a stimulation treatment apparatus comprises operating pumping equipment to pump a clean frac fluid at a desired high pressure into a high-pressure line; isolating a pressure vessel connected to the high-pressure line from the high-pressure line; introducing a proppant into the pressure vessel; introducing an additive into the pressure vessel thereby mixing the proppant and the additive into a proppant-additive slurry; increasing the pressure in the pressure vessel to exceed the clean frac fluid pressure; and opening a valve from the pressure vessel into the high-pressure line thereby introducing the proppant-additive slurry into the high-pressure line downstream of the pumping equipment.

DETAILED DESCRIPTION

Figure 1:
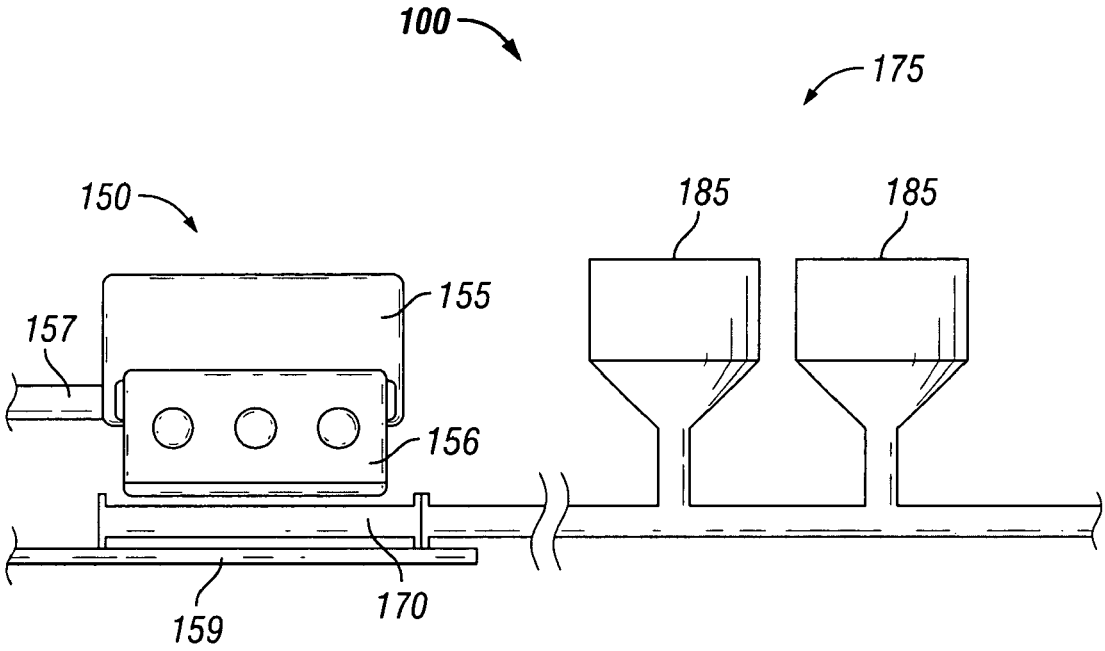
FIG. 1 is a high-level schematic illustration of an oilfield material delivery mechanism used to introduce an oilfield material into a high-pressure fluid flow to a well bore.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

It should also be noted that in the development of any such actual embodiment, numerous decisions specific to circumstance must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

Disclosed herein is an apparatus and method for introducing an oilfield material, such as proppant, proppant coating, and proppant additives on the high-pressure side of a hydraulic well stimulation system. Proppants and any additives are introduced into one or more pressure vessels at low pressure. After proppants and any additives have been introduced into the pressure vessel, the pressure vessel inlets used to add proppant and/or additives to the pressure vessel are closed, and a diversion of high-pressure fluid from the high-pressure line is used to pressurize the pressure vessel to a pressure slightly above the pressure of the high-pressure line. When the pressure has increased sufficiently to cause a flow from the pressure vessel into the high-pressure line, a fluid pathway from the pressure vessel to the high-pressure line is opened causing the majority of fluid flow to pass through the pressure vessel thereby carrying proppant and any additives into the high-pressure line and subsequently into the wellbore and the formation.

The apparatus and method described herein provides for an economical, reliable, and scalable mechanism for introducing proppant, coated proppants, and proppant additives into a the high-pressure fluid used to treat or crack formations in hydraulic stimulation treatments without pumping the proppant and additives through the high-pressure pumps and without resorting to complex machinery.

FIG. 1 is a high-level schematic illustration of an oilfield material delivery mechanism 100 used to introduce an oilfield material, such as proppant and proppant additives into a high-pressure fluid flow used in the stimulation of subsurface formations through an wellbore. The oilfield material delivery mechanism 100 is made up primarily of pressure inducing equipment 150, such as the triplex pump shown, and material supply equipment 175. As detailed below, the material supply equipment 175 is linked to the pressure inducing equipment 150 for delivery of oilfield material including proppants and, possibly, proppant additives into a wellbore, borehole, or well 320 at an oil field 301 (See FIG. 14).

Figure 14:
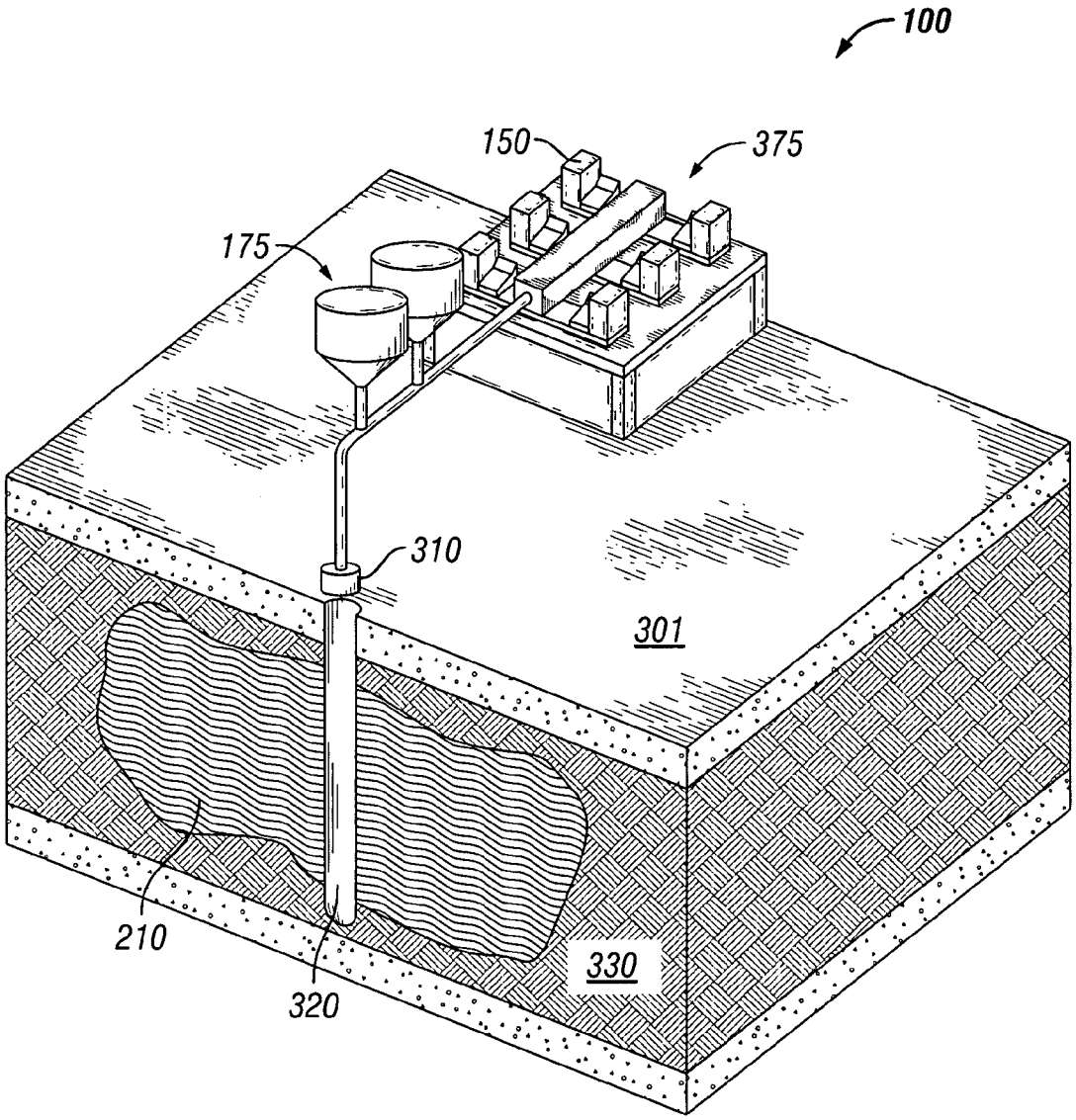
FIG. 14 is a perspective overview of the oilfield material delivery mechanisms of FIGS. 1 through 13 employed in an oilfield.

As shown in FIG. 1, the pressure inducing equipment 150 includes a positive displacement triplex pump atop a skid 159. The pump includes a conventional crankshaft 155 that is powered by a driveline 157 to generate pumping of an oilfield fluid from a fluid end 156 of the pump and through a fluid line 170 toward the material supply equipment 175 and ultimately to the noted well 320 (FIG. 14). More specifically, the pressurization of the oilfield fluid may be a result of coordinated reciprocation of plungers and striking of sealing valves of the fluid end 156 to generate pressures of up to about 20,000 PSI, for employment in a fracturing application.

Continuing with reference to FIG. 1, the material supply equipment 175 of the oilfield material delivery mechanism 100 is shown linked to the pressure inducing equipment 150 through a fluid line 170 as indicated above. Material supply equipment 175 is connected to the fluid line 170 such that oilfield material 275 (See FIG. 5 et. seq below) may be supplied from one or more oilfield material delivery subassemblies 185 into the fluid line 170 in one of the many embodiments described herein below and alternatives thereto. For a fracturing operating, the oilfield material 275 may include at least one proppant such as, but not limited to, sand, ceramic material or a bauxite mixture. The oil field material 275 disposed in the supply reservoir 201 may comprise more than one material such as, but not limited to, sand, ceramic material, fiber, a bauxite material, and combinations thereof, as will be appreciated by those skilled in the art. Additionally, other abrasives or potentially caustic materials may be employed for a variety of other applications such as a cement slurry for cementing. With this in mind, the material supply equipment 175 is configured to deliver the oilfield material 275 to the oilfield fluid flow within the fluid line 170 in a synchronized and isolated manner. Thus, the pressure inducing equipment 150, including for example, pump components of the fluid end 156 that might be susceptible to damage upon exposure to the oilfield material, may substantially avoid such exposure. Conversely, some oilfield material, for example coatings applied to proppants, which might be damaged if exposed to pressure inducing equipment, may similarly avoid such exposure.

Figure 2:
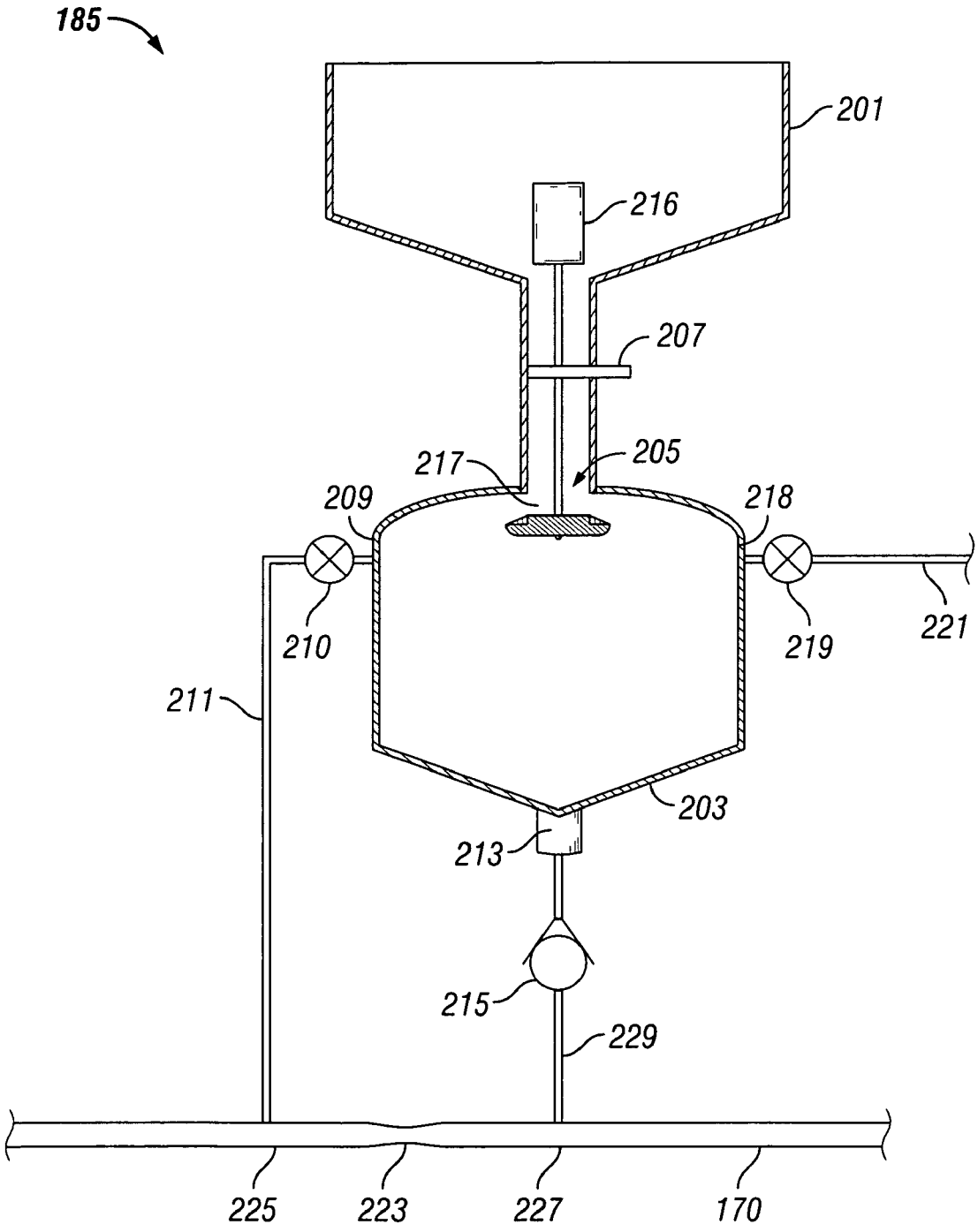
FIG. 2 is a cross-section schematic of one of the oilfield material delivery subassemblies of FIG. 1 and related equipment.

FIG. 2 is a cross-section schematic of one of the oilfield material delivery subassemblies 185 and related equipment. It should be noted, and as discussed in greater detail below, that in embodiments multiple subassemblies 185 may be deployed and synchronized to cooperate to provide a controlled flow of oilfield material into the fluid line 170. FIG. 2 illustrates just one such subassembly 185. In brief, an oilfield material delivery subassembly 185 includes a reservoir and a pressure vessel. These are connected to one another using a combination of valves to allow metering of material delivered from the reservoir into the pressure vessel and for isolating the two from one another. The pressure vessel is further connected to a high-pressure line that may be used to deliver clean fracturing fluid into the pressure vessel and for pressurizing the pressure vessel. The pressure vessel is further connected to the fluid line 170 through a discharge port such that when pressurized fluid flow may occur from the pressure vessel into the fluid line 170. The pressure vessel also may include an overflow outlet to allow displaced fracturing fluid to exit the pressure vessel as oilfield material is introduced into the pressure vessel. The inlet for clean fracturing fluid, the discharge port, and the overflow outlet all contain high-pressure valves that may be used to selectively isolate the pressure vessel from the respective lines to which these inlets, ports, and outlets are connected to allow for introduction of oilfield material from the oilfield material reservoir into the pressure vessel with corresponding exit of overflow of fracturing fluid, pressurization of the pressure vessel and, subsequently, release of slurry from the pressure vessel into the fluid line 170.

Continuing now with FIG. 2, an oilfield material supply reservoir 201 is connected to a pressure vessel 203 via an oilfield material supply inlet aperture 205 preferably located at the top of the pressure vessel 203. The oilfield material supply reservoir 201 may be, for example, a funnel, a silo, a hopper, or an equivalent piece of equipment suitable for delivering a solid material by gravity from one vessel into another through an aperture.

A metering gate valve 207, e.g., a feeder valve, is connected between the pressure vessel 203 and the oilfield material supply reservoir 201 so that the quantity of the oilfield material 275 (See FIG. 5 et. seq below) delivered into the pressure vessel 203 may be controlled.

The interior of the pressure vessel 203 may be isolated from the oilfield material supply reservoir 201 using refill valve 217. The refill valve 217 may be a check valve that only allows flow from the reservoir 201 into the pressure vessel 203, but not in the opposite direction.

The pressure vessel 203 further contains a first liquid inlet 209 in fluid communication with a high-pressure line 211 and the pressure vessel 203. The inlet 209 comprises a high-pressure valve 210 that may be operated to isolate the interior of the pressure vessel 203 from the high-pressure line 211.

When the refill valve 217 is open and the metering gate valve 207 is open oilfield material 275 flows by gravity from the reservoir 201 into the pressure vessel 203. The introduction of oilfield material 275 into the pressure vessel causes displacement of any fluid already in the pressure vessel 203. As will be appreciated from the discussion herein below, during normal operations of the subassembly 185, fracturing fluid continuously flows through the pressure vessel 203 during a slurry release phase until the inlet high-pressure valve 210 is closed. At that point, pressure equalizes between the pressure vessel 203 and the fluid line 170 causing the discharge valve 215 to close. At that point the pressure vessel 203 will have fluid up to about the level of the inlet port 209. Therefore, during the recharge phase, as oilfield material 275 is introduced, there will be a displacement of fluid by the introduced oilfield material 275. That overflow may leave the pressure vessel 203 through an overflow outlet 218. The overflow outlet 218 may further include an overflow valve, such as a high pressure valve 219 to isolate the interior of the pressure vessel 203 from an overflow return pipe 221. The return pipe 221 may be connected to a clean fluid reservoir.

The pressure vessel 203 further has an oilfield material discharge outlet 213 in fluid communication with the pressure vessel 203 and the fluid line 170 and comprising a discharge valve, such as a check valve 215. The discharge check valve 215 may be designed to block flow from the fluid line 170 into the pressure vessel 203 while allowing, when opened, flow from the pressure vessel 203 into the fluid line 170.

In one embodiment, the high-pressure line 211 feeding into the pressure vessel 203 is connected as a diversion to the main fluid line 170. A choke 223 located on the high pressure fluid line 170 between the connection 225 of the high-pressure diversion line 211 to the high pressure fluid line 170 and the connection 227 of the pressure vessel discharge line 229 to the high pressure fluid line 170, reduces the pressure in the fluid line 170 below the pressure introduced into the pressure vessel 203 through the diversion line 211. The produced pressure differential causes the opening of the discharge check valve 215 and the main fluid flow to pass through the pressure vessel 203 thereby discharging the contents thereof into the fluid line 170.

Figure 3:
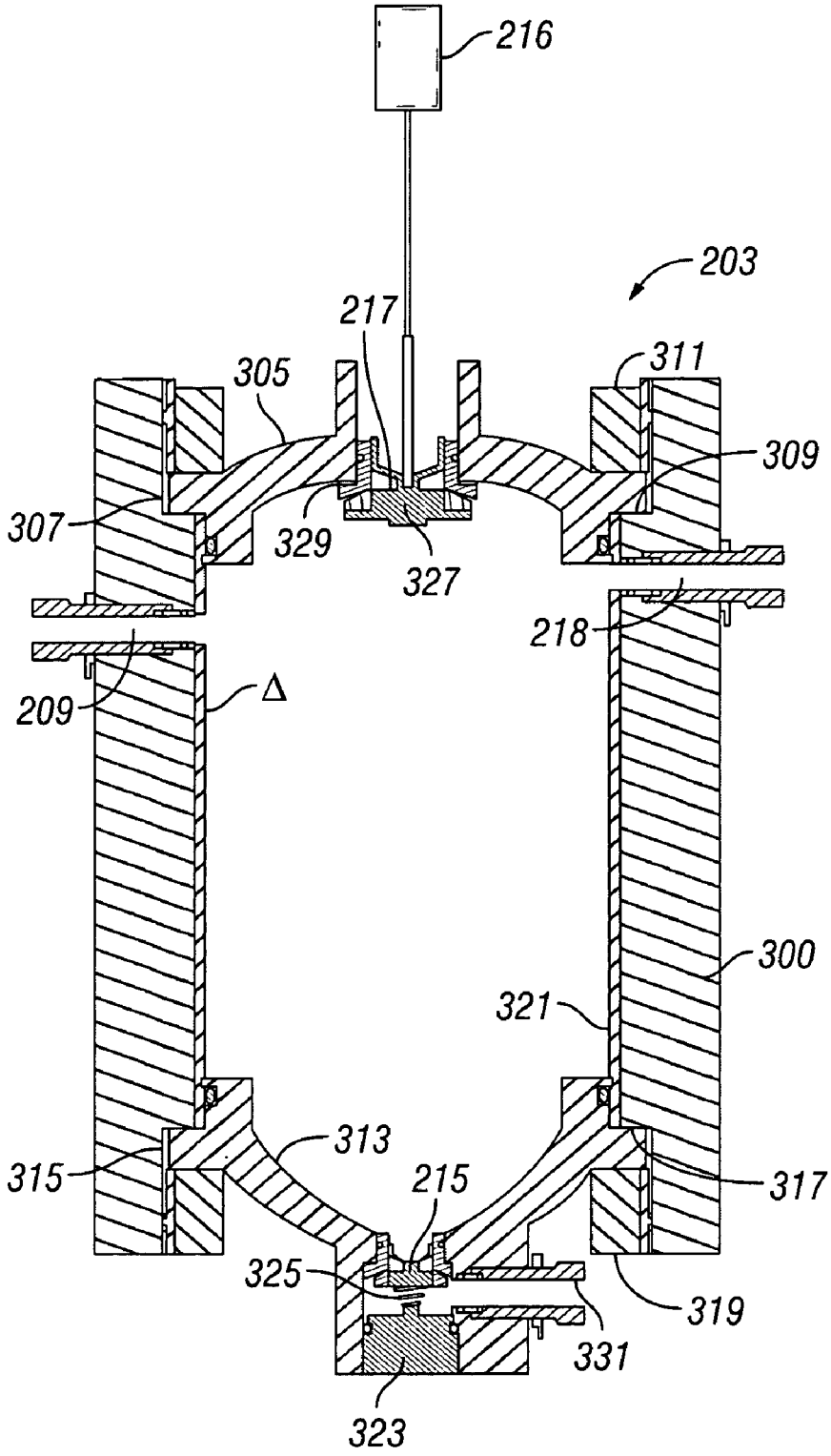
FIG. 3 is a detailed cross-section providing structural details of one embodiment of the pressure vessel illustrated in FIG. 2.

FIG. 3 is a detailed cross-section providing structural details of one embodiment of the pressure vessel 203. The pressure vessel 203 may be constructed to have a cylindrical wall that includes the first liquid inlet 209 and the overflow outlet 218 integrated into the cylindrical wall.

A top head 305 having a flange 307 may be secured to a recess 309 of the steel pipe 300 using a retainer nut 311. Similarly, a bottom cap 313 having a flange 315 may be secured to a recess 317 of the steel pipe 300 using a retainer nut 319. An interference fitted steel lining 321 may be used to line the interior wall of the steel pipe 300. The steel lining 321 may be advantageously replaced when worn from abrasion or corrosion.

In one embodiment, the discharge valve 215 is a standard discharge valve used in high pressure positive displacement pumps to passively close through action of a spring 325 and accessible through a discharge valve cover 323. In an embodiment, the discharge valve 215 is a valve that may be opened and closed using a linear actuator 216 or similar suitable actuator. The refill high-pressure valve 217 may be composed of a valve disk 327 with mating surfaces that seat on a valve seat 329 of the top cap 305. The valve disk 327 may be caused to move, thereby selectively opening or closing the valve 217 using a linear actuator or similar suitable actuator located inside the reservoir 201 connected to the valve disk 327.

In the embodiment of pressure vessel 203 illustrated in FIG. 3, the discharge valve 215 is connected to the fluid line 170 using a discharge line 331 connected in a bend through the discharge valve 215. The discharge line 331 is then connected to the fluid line 170 using a T-junction (not shown) or similar suitable connection on the fluid line 170.

Figure 4:
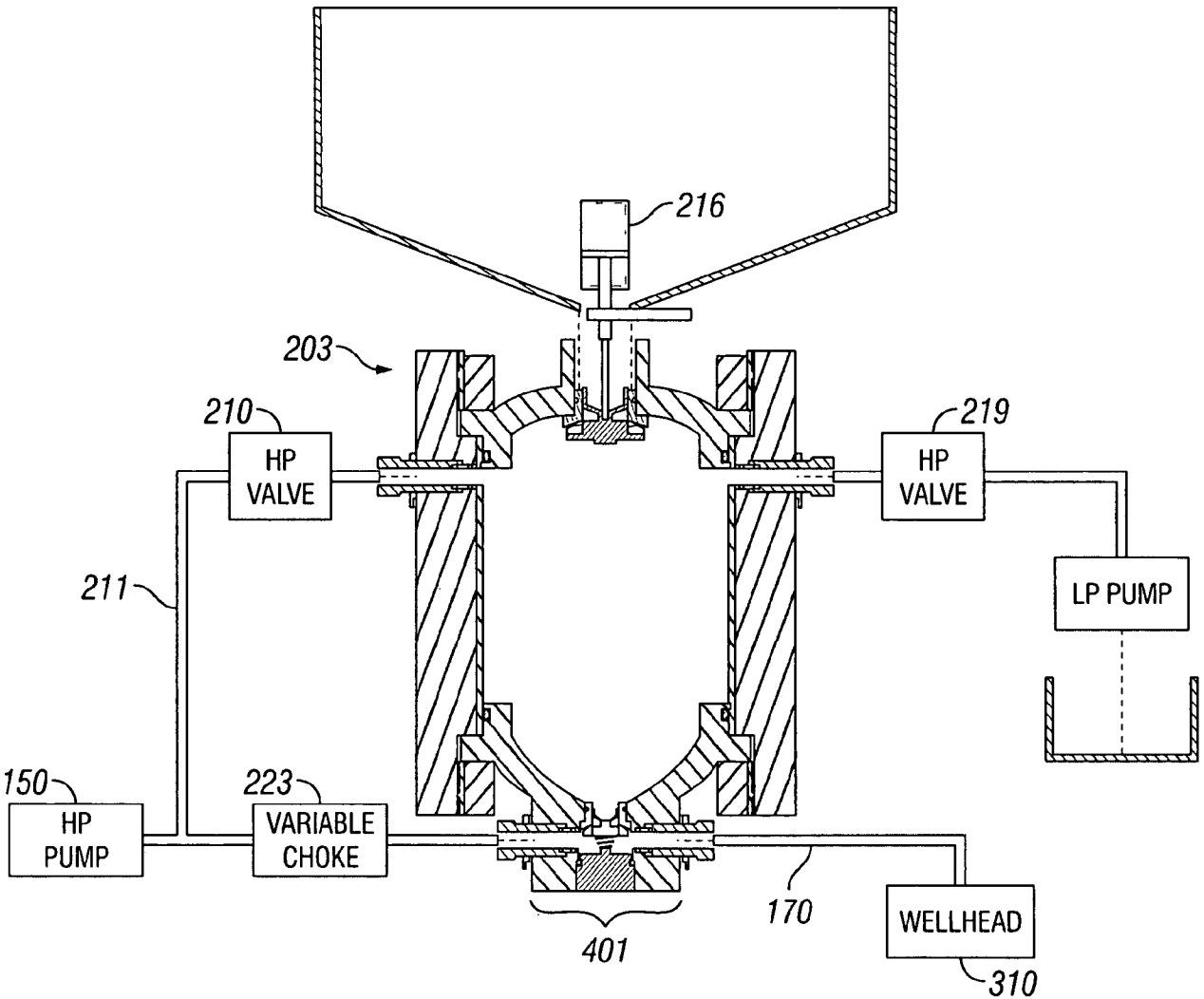
FIG. 4 illustrates an embodiment for connecting the pressure vessel of FIGS. 2 and 3 to a high-pressure fluid line.

FIG. 4 illustrates an embodiment for connecting the pressure vessel 203 to the fluid line 170. A pass-through valve assembly 401 allows in-line connection of the pressure vessel 203 to the fluid line 170.

Figure 5A:
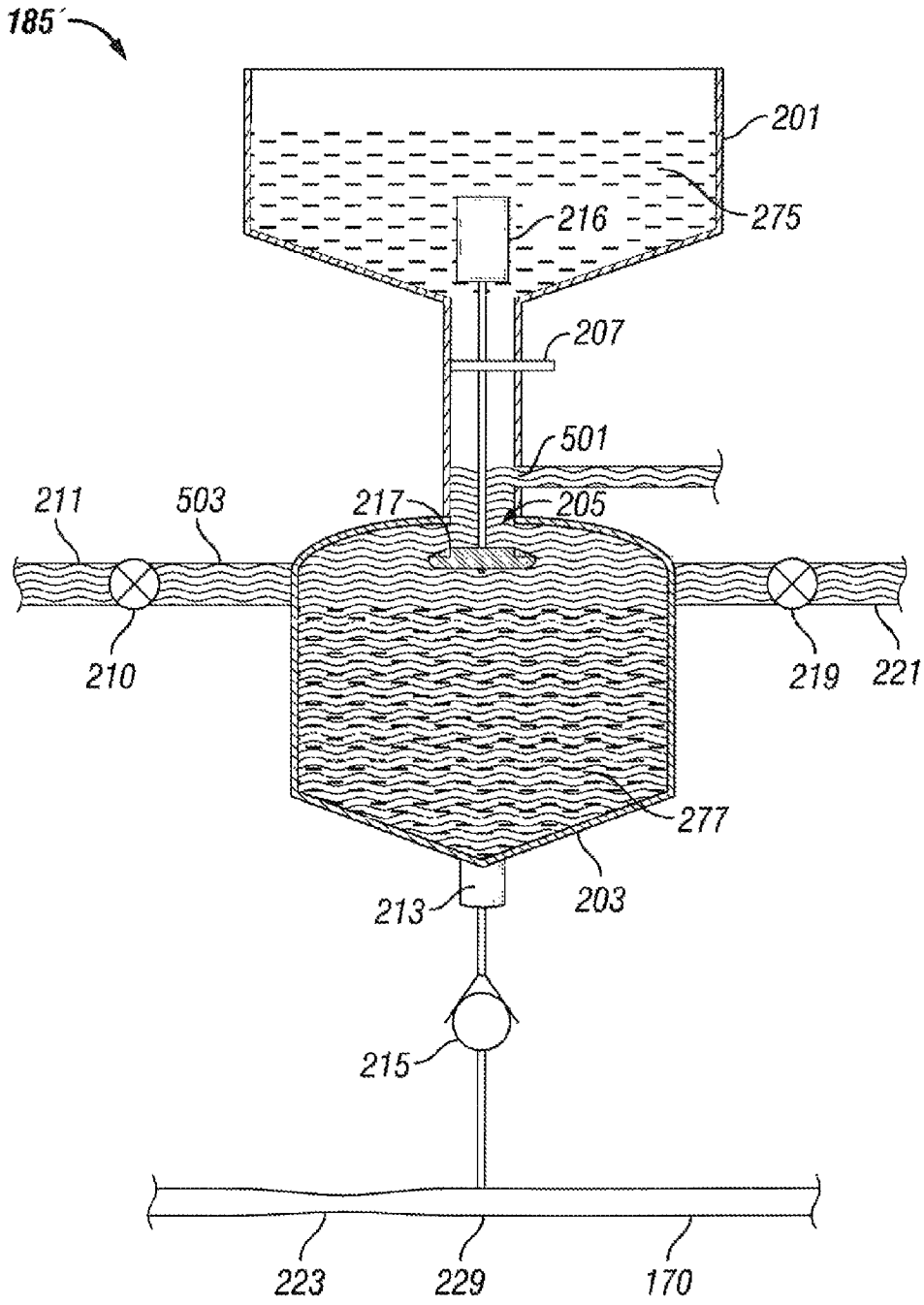
FIGS. 5*a* and 5*b* are schematic illustrations of two approaches for dealing with overflow of fluid resulting from the introduction of oilfield material into the pressure vessel of FIGS. 2 through 4.
Figure 5B:
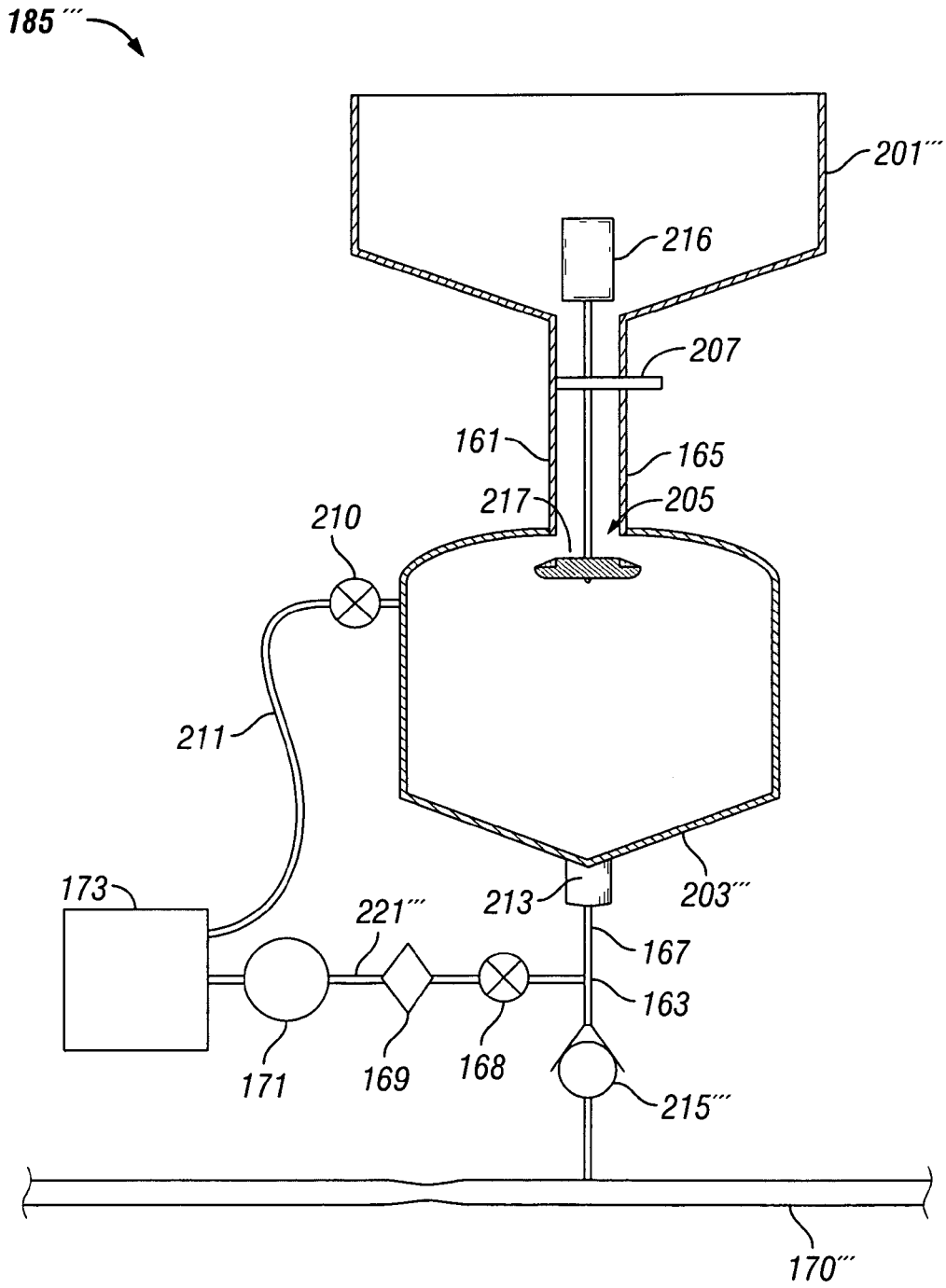

FIGS. 5*a* and 5*b* are schematic illustrations of two alternative approaches for dealing with overflow of fracturing fluid resulting from the introduction of oilfield material into the pressure vessel 203. FIG. 5*a* is a cross-section of an embodiment of the oilfield material delivery subassembly during a recharging operation. In the embodiment of FIG. 5*a* the subassembly 185' contains a perforated pipe 501 connecting the pressure vessel 203 to the reservoir 201.

As discussed herein above, the pressure vessel 203 goes through two major operational stages, referred to herein is as Stage 1: refill and Stage 2: release. In Stage 1: a low-pressure recharging phase in which oilfield material 275 is introduced into the pressure vessel 203 via gravity from the reservoir 201. In Stage 2: after the pressure vessel 203 has been charged with oilfield material 275, the pressure vessel 203 is, by operation of the valves on inlets and outlets thereto, transitioned into a high-pressure phase in which the contents of the pressure vessel 203 is released into the fluid line 170.

FIG. 5*a* illustrates the recharging phase. During the recharging phase, the oilfield material 275 enters the pressure vessel 203 from the reservoir 201 and flows to the lower portion of the pressure vessel 203 by operation of gravity and mixes with fracturing fluid 503 to form a slurry 277. This oilfield material 275 displaces some of the fluid present in the pressure vessel 203. The overflow caused by the displaced fluid exits the pressure vessel 203 through the overflow outlet 218. In the embodiment 185', the overflow fluid also exits the pressure vessel 203 through the oilfield material inlet aperture 205 into the perforated pipe 501. The overflow fluid may then exit the pipe through the perforations.

FIG. 5*b* is a cross-section of an embodiment for dealing with the excess of fracturing fluid produced by the introduction oil field material into the pressure vessel. A pressure vessel 203''' only has the high pressure clean fluid inlet 209, the oil field material inlet aperture 205 and slurry discharge port 213 (as well as associated valves 210, 217, and 215, respectively). The overflow outlet 221''' is located at T-junctions 163 on the discharge pipe 167, respectively. As the start of refilling operations, a fixed amount of the displaced clean fluid (equal to the volume of the oil field material 275 that will be introduced) is first pumped out of the pressure vessel 203''', before the introduction of oil field material 275, by a low-pressure pump 169 through an overflow pipe 221''' connected to the T-Junction 163 on the discharge pipe 167 through a filter 171 into the fracturing fluid tank 173. The overflow pipe 221''' is selectively isolated from the discharge pipe 167 by a high-pressure valve 168.

The operation of filling and discharging the pressure vessel 203''' is analogous to that of pressure vessels 203 and 203' described hereinabove; analogous equipment is indicated using the same reference numeral with the superfix ''' (triple prime).

Figure 6:
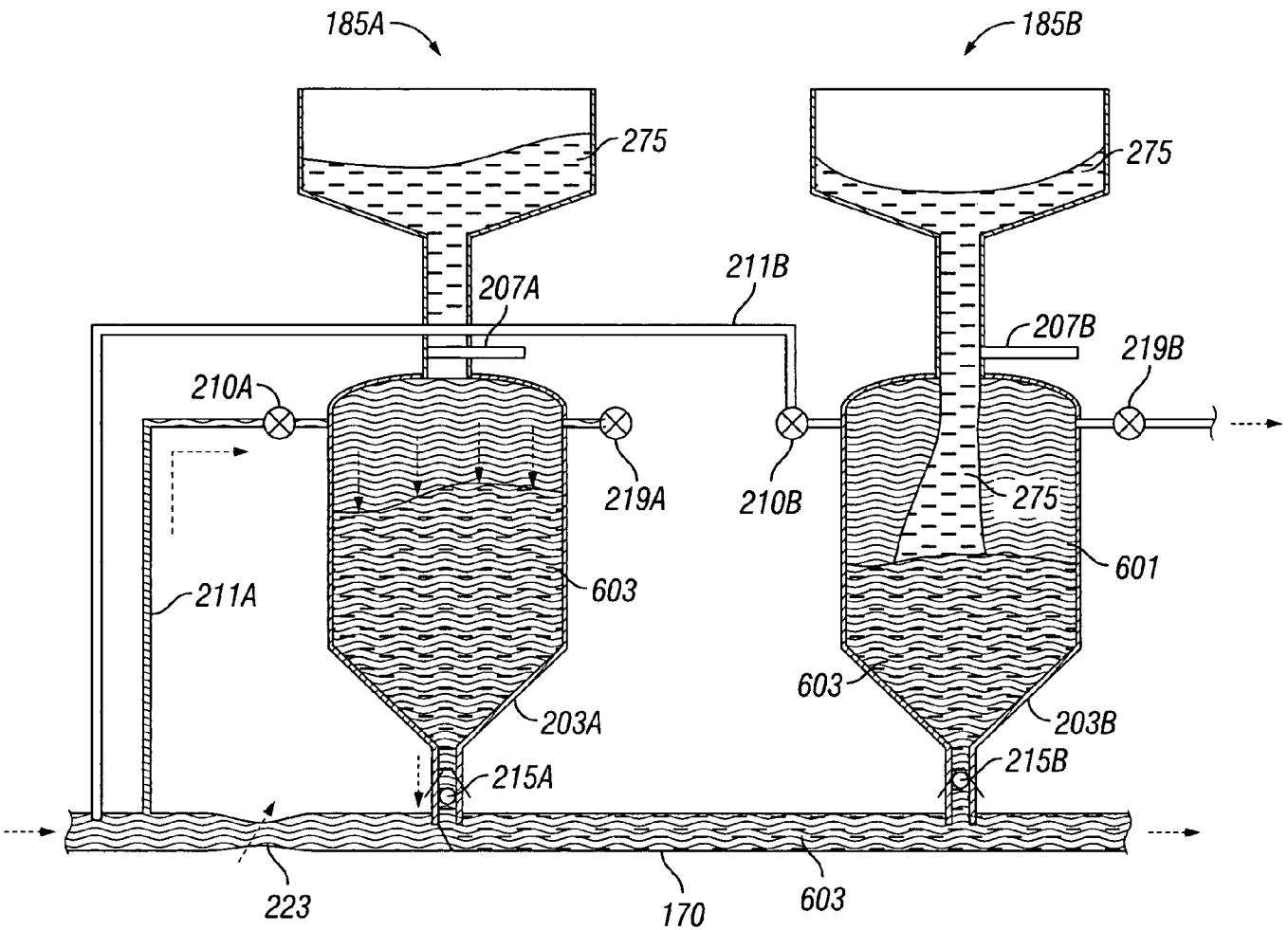
FIG. 6 illustrates a pair of subassemblies for delivery of oilfield material and that are synchronized

The subassemblies 185 may be combined into arrays of subassemblies that when synchronized appropriately may produce a near-continuous flow of slurry having the oilfield material 275 mixed with fracturing fluid. FIG. 6 illustrates a pair of subassemblies 185*a* and 185*b* that are synchronized. The subassembly 185*b* on the right of FIG. 6 is operating in Stage 1: recharge. The high-pressure line 211*b* is shut-off by high-pressure valve 210*b;* the gate valve 207*b* and refiner valve 217*b* (not shown) are open, allowing oilfield material 275 to drop by gravity into the pressure vessel 203*b*. In the pressure vessel 203*b* the oilfield material 275 mixes with clean fluid 601, such as fracturing fluid. The overflow high-pressure valve 219*b* is open allowing overflow to exit the pressure vessel 203*b*. Because the pressure vessel 203*b* is not pressurized, the discharge check valve 215*b* is closed.

The subassembly 185*a* on the left of FIG. 6 is operating in Stage 2: discharge. The high-pressure line 211*a* is flowing through the open high-pressure valve 210*a;* the gate valve 207*a* and refiner valve 217*a* (not shown) are closed, preventing oilfield material 275 from dropping into the pressure vessel 203*a*. In the pressure vessel 203*a* the oilfield material 275 has previously mixed with clean fracturing fluid 601 producing a slurry 603. The overflow high-pressure valve 219*a* is closed. Because the pressure vessel 203*a* is pressurized by the high-pressure flow through high-pressure line 211*a* and the pressure in the fluid line 170 has been reduced by the choke 223, the discharge check valve 215*a* is open permitting the slurry 603 to flow into the fluid line 170.

The operations of the pressure vessels 203*a* and 203*b* may be coordinated such that when one pressure vessel goes offline for charging, the other pressure vessel begins releasing slurry thereby producing a near-continuous flow of slurry into the fluid line 170.

Figure 7:
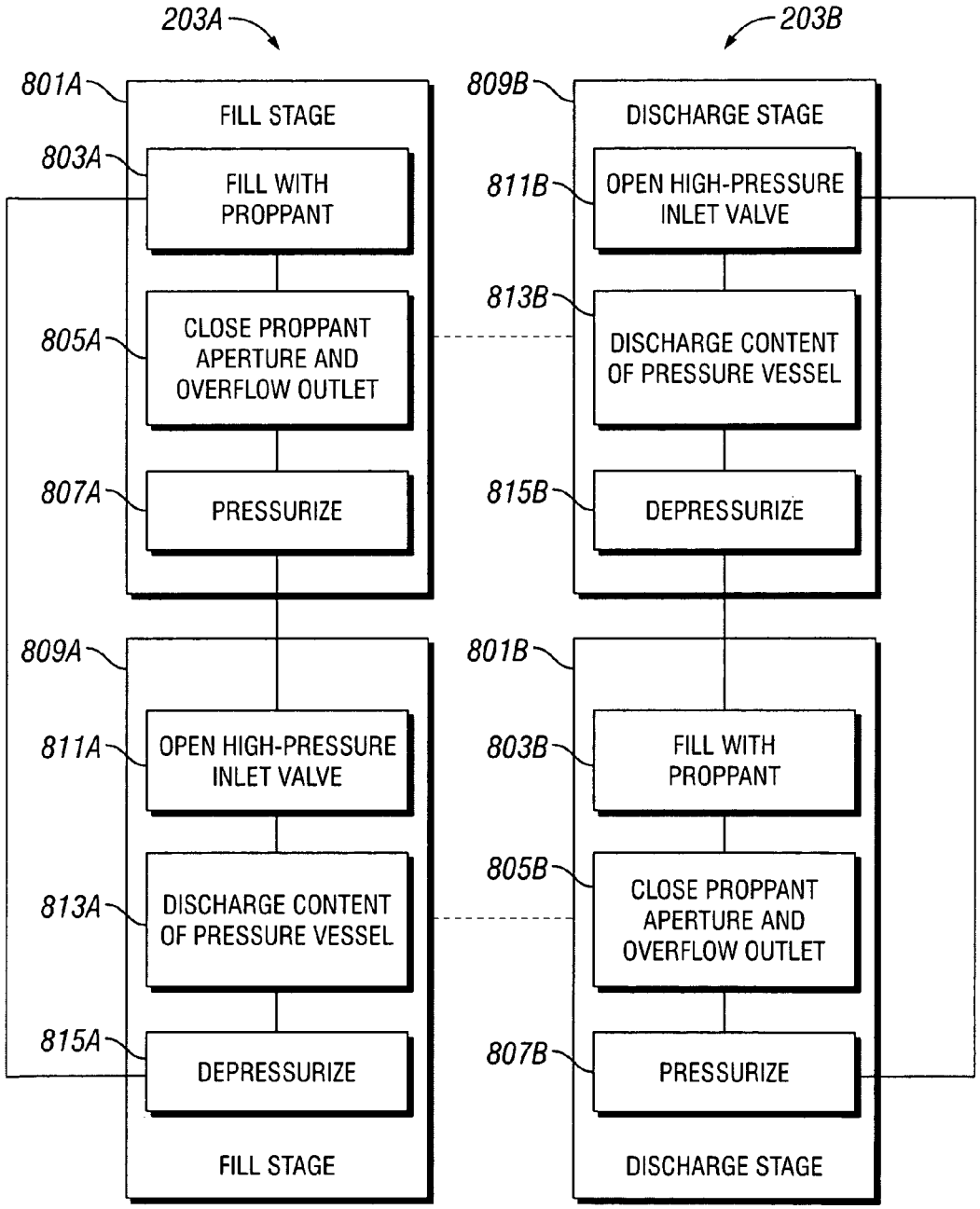
FIG. 7 is a flow chart illustrating the coordination of stages of two pressure vessels of FIG. 6.

FIG. 7 is a flow chart illustrating the coordination of the stages of two pressure vessels 203*a* and 203*b*, respectively. Each fill stage 801 consists of filling the pressure vessel 203 with oilfield material 275 such as proppant or the like, steps 803*a* and 803*b*, respectively; closing the refilling aperture and the overflow outlet, steps 805*a* and 805*b*, respectively; and opening the high-pressure flow into the pressure vessel, step 807*a* and 807*b*, respectively. Conversely, each discharge stage 809 consists of opening the high-pressure inlet valve, steps 811*a* and 811*b*, respectively; allowing the content, i.e., the slurry, to exit the pressure vessel, steps 813*a* and 813*b*, respectively; and closing the high-pressure inlet flow and depressurizing the pressure vessel, step 815*a* and 815*b*, respectively. It should be noted that the steps of pressurizing 807*a* and *b*, and depressurizing 815*a* and *b*, are optional steps used to protect valves and other equipment from the pressure driven blast of fluid that result form opening a valve when there is a large pressure differential between the two sides of the valve (See FIG. 9 and accompanying discussion below).

The fill stage 801*a* of the pressure vessel 203*a* may be coordinated to coincide with the slurry release stage 809*b* of the pressure vessel 203*b*, and the fill stage 801*b* of the pressure vessel 203*b* may be coordinated to coincide with the discharge stage 809*a* of the pressure vessel 203*a*.

Refilling a pressure vessel 203 with oilfield material 275 may take longer than discharging the pressure vessel 203. Thus, if the pressure vessel 203 in stage 1 has not finished charging when the other pressure vessel 203 has finished releasing the slurry flow in fluid line 170 would be interrupted and an interval of clean fluid would pass through the fluid line 170. While that may at times be a desirable operational technique used by an operator of the oilfield delivery mechanism 175, it is desirable to be able to control that behavior. To allow for longer refill times than discharge times as well as increase the injection rate of the oilfield materials, more than two subassemblies 185 may be combined into a larger mechanism 100.

Figure 8:
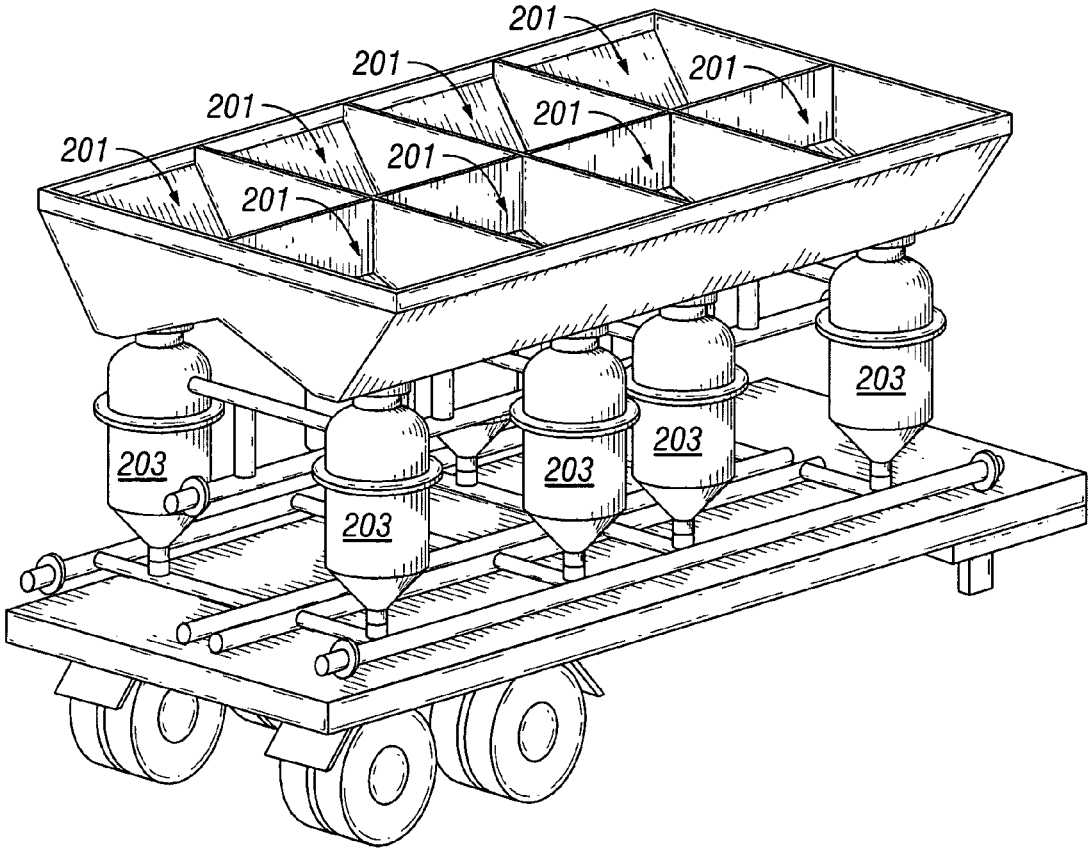
FIG. 8 is a perspective view of trailer mounted oilfield material delivery mechanism constructed as an array of pressure vessels, oilfield material reservoirs, related valves, and connecting pipes.

FIG. 8 is a perspective view of trailer mounted oilfield material delivery mechanism 175' consisting of an array of eight subassemblies for oilfield material delivery 185 each containing a pressure vessel 203 and an oilfield material reservoir 201.

The coordination of the filling and slurry release of multiple pressure vessels is timed such that at least one pressure vessel is releasing slurry when the other pressure vessels are charging. Consider n pressure vessels that are indexed 1 through n. When a pressure vessel numbered i mod n+2 transitions from stage two to stage one, i.e., going from slurry release to filling, pressure vessel number i mod n+1 is made to transition from stage one to stage two, i.e., going from filling to discharging.

The amount of slurry to be delivered into the wellbore or borehole 320 (See FIG. 14) may also need to be increased beyond the capacity of a single pressure vessel 203. Therefore, subassemblies 185 may be combined in parallel and work together in the same stage. Such pairs (or triples, quadruples, etc.) are then made to transition between stage one and stage two in unison or out-of-sync to produce a higher injection rate with a higher degree of near-continuousness. For example, in the illustration of FIG. 8, four pairs of subassemblies 185 are shown. Each pair is a coordinated unit in which the members of the pair are coordinated to alternate between recharging and slurry release. The four pairs are made to operate out of sync with one another such that the pairs switch between Stage 1 and Stage 2 at different times. This mode of operation increases the continuousness of the slurry flow.

Tremendous pressure differential may exist between the high-pressure side and the low-pressure side of the valves used in the oilfield material delivery mechanism 175. The high-pressure side is typically in excess of 10,000 PSI, sometimes as high as 20,000 PSI. The low-pressure side, on the other hand, is normally one atmosphere, i.e., 0 PSI (gauge). Opening valves to such pressure differential causes a tremendous blast of fluid through the valve and very rapid deterioration of the valve and nearby surfaces. To avoid that problem, in one embodiment, pressure multipliers and reducers are employed.

Figure 9:
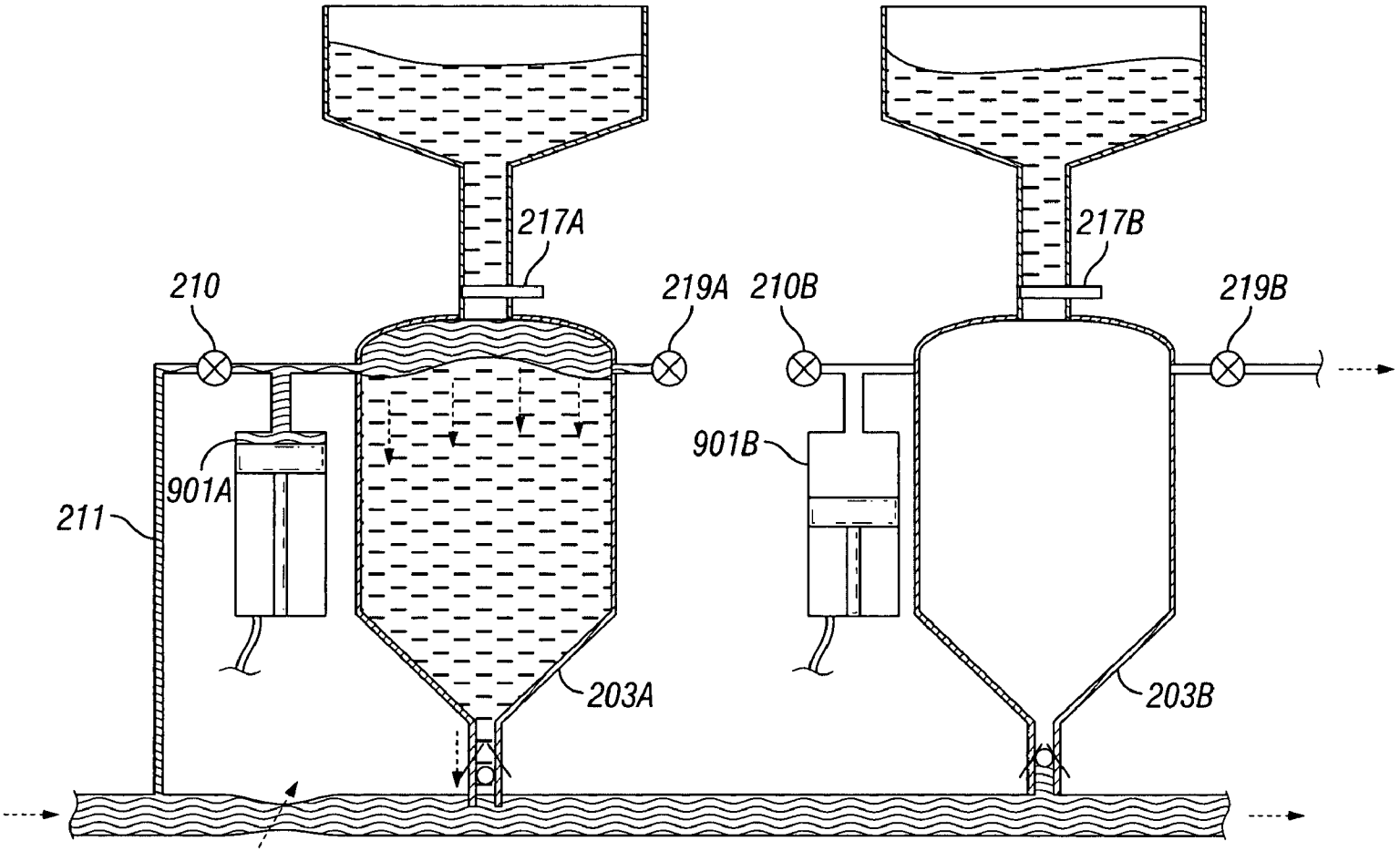
FIG. 9 is a schematic illustration of an embodiment similar to the illustration of FIG. 7 in which the pressure vessel may be pre-pressurized and pre-depressurized prior to opening valves.

FIG. 9 is a schematic illustration of an embodiment similar to the illustration of FIG. 7. In this embodiment, the high-pressure inlet line 211 is augmented with a pressure multiplying hydraulic cylinder 901. The hydraulic cylinder 901*a* on the left-hand side of the figure has been compressed, thereby increasing the pressure inside the pressure vessel 203*a*. Conversely, in the illustration of pressure vessel 203*b*, the hydraulic cylinder 901*b* has been released, thereby decreasing the pressure inside the pressure vessel 203*b*. These operations are performed prior to opening the high-pressure inlet valves 210*a* and 210*b*, respectively, the refill valves 217*a* and 217*b*, respectively, and the overflow valves 219*a* and 219*b*, respectively, thereby equalizing the pressure prior to opening valves and thereby avoiding wear associated with the blast of fluid caused by a large pressure differential over a valve as it opens.

Hereinabove, a gravity fed oilfield delivery mechanism 175 has been described in which gravity operates to transport oilfield material through a vertically oriented pressure vessel 203 from an oilfield material supply inlet aperture 205 to a discharge outlet 213 located at the bottom of the pressure vessel 203. Such an arrangement presupposes two things: the vertical arrangement of the pressure vessel 203 and that the specific gravity of the oilfield material 275 is heavier than the fluid in the pressure vessel 203. In an embodiment, the pressure vessel is horizontally oriented. Thus, in that embodiment, gravity will not suffice to move the oilfield material 275 through the pressure vessel rather an internally located screw is used to move material through the pressure vessel from the inlet aperture to the discharge outlet.

Figure 10:
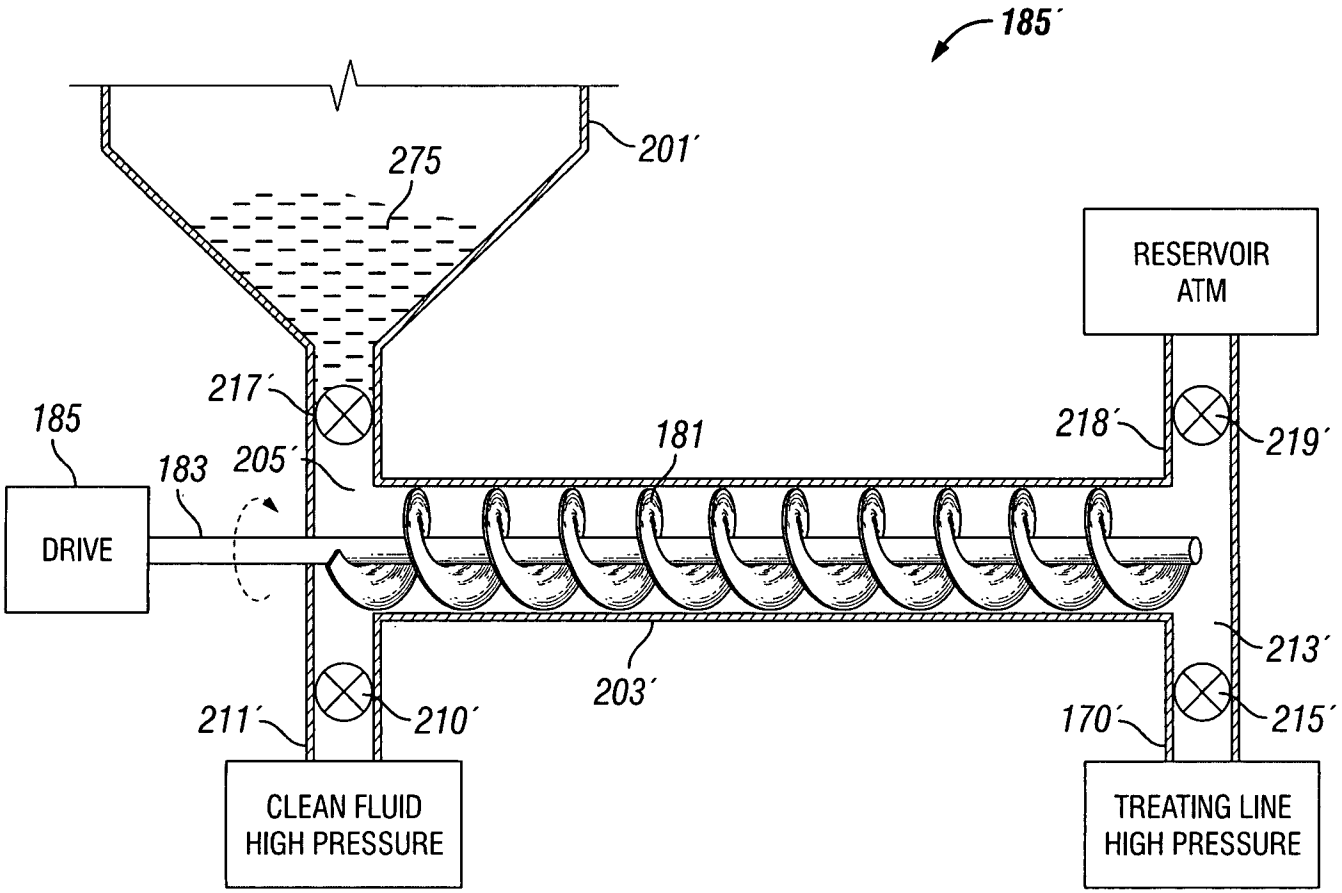
FIG. 10 is a cross-section of an oilfield material delivery mechanism having a horizontally oriented pressure vessel.

FIG. 10 is a cross-section of a horizontally oriented pressure vessel 203' suitable for introducing an oilfield material 275 into a fluid line 170 according to the general principles described hereinabove and related equipment. The pressure vessel 203' may be a tubular vessel—preferably constructed from steel or another suitable material for containing a contents at high-pressure.

As described hereinabove, an oilfield material supply reservoir 201' is connected to the pressure vessel 203' via an oilfield material supply aperture 205'. The flow of oilfield material 275 into the pressure vessel 203' may be controlled through a feeder valve (not shown) and the pressure vessel 203' may be isolated from the reservoir 201' using a high-pressure valve 217'.

During Stage 1: refill operations, oilfield material 275 drops through gravity into the pressure vessel 203'. Inside the pressure vessel 203' the oilfield material is advanced from the feeding end of the pressure vessel 203' using an internally located screw 181. The screw is connected to a centrally located driveshaft 183 and driven by an external drive 185.

As in the gravity feed examples, overflow created by the introduced oilfield material 275 may exit through an overflow outlet 218' controlled by a high-pressure valve 219'. During Stage 2: discharge operations, high-pressure clean fluid enters from the high-pressure line 211' and the slurry of fracturing fluid mixed with oilfield material 275 exits through a discharge outlet 213' into the fluid line 170'.

As with the vertically oriented pressure vessel 203 described hereinabove, horizontally oriented pressure vessels 203' may be combined into larger systems in which multiple units are coordinated to alternate between Stage 1: refill operation and Stage 2: discharge operation to provide a near-continuous flow of slurry into the fluid line 170' in the manner described hereinabove, for example, in conjunction with FIGS. 7 through 9.

Figure 11A:
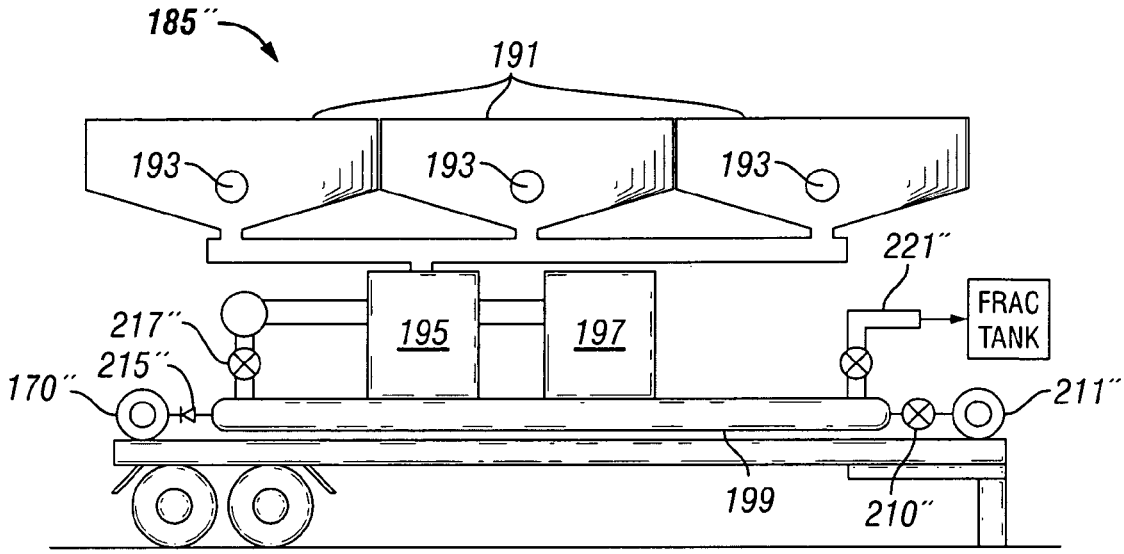
FIG. 11, which is composed of FIGS. 11*a* and 11*b*, is a schematic diagram of an embodiment of an oilfield delivery mechanism having a horizontally oriented pressure vessel.
Figure 11B:
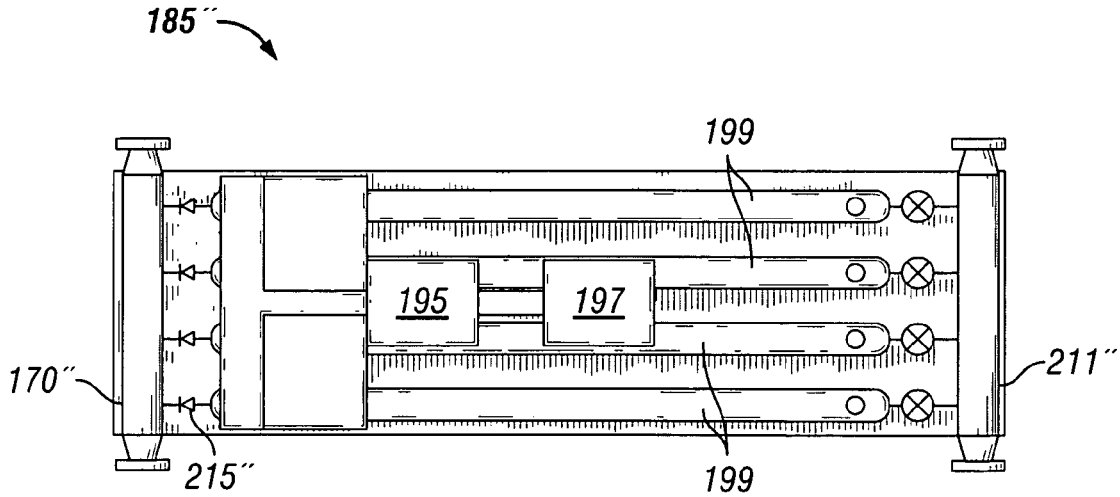

FIG. 11 (which is divided into FIGS. 11*a* and 11*b*) illustrates an embodiment of a horizontally oriented pressure vessel 203" used for introducing oilfield material on the high-pressure side of a hydraulic fracturing operation. FIG. 11*a* is a side view of an oilfield material delivery mechanism 185". FIG. 11*b* is a cross-section top view of the oilfield material delivery mechanism 185" illustrated in FIG. 11*a* along the line a-a. The oilfield material delivery mechanism 185" consists of one or more reservoirs 191. Each of the reservoirs 191 in connected to a clean fluid pipe (not shown) via a clean fluid inlet 193. By introducing clean fluid into the reservoirs 191 together with oilfield material 275, a slurry is produced inside the reservoirs 191. The slurry drops through gravity into a low-pressure slurry pump 195 powered by a power source 197. During Stage 1: refill operations the low-pressure pump 195 pumps the slurry into one or more horizontally oriented pressure pipes 199. The pressure pipes 199 take the role of the pressure vessels 203 and 203' described hereinabove. However, pressure pipes 199 typically would be standard high-pressure pipes normally used for high-pressure fluid conveyance, e.g., in hydraulic fracturing operations. Such pipes having an inner diameter of less than 6 inches may not be suitable for implementations using an internal screw drive as discussed hereinabove in conjunction with FIG. 10.

Except for aforementioned differences, the operation and structure of the oilfield material delivery mechanism 185" is analogous to that of oilfield delivery mechanisms 185 and 185' described hereinabove; similar components have been designated with like reference numerals given the superfix " (double-prime).

Figure 12:
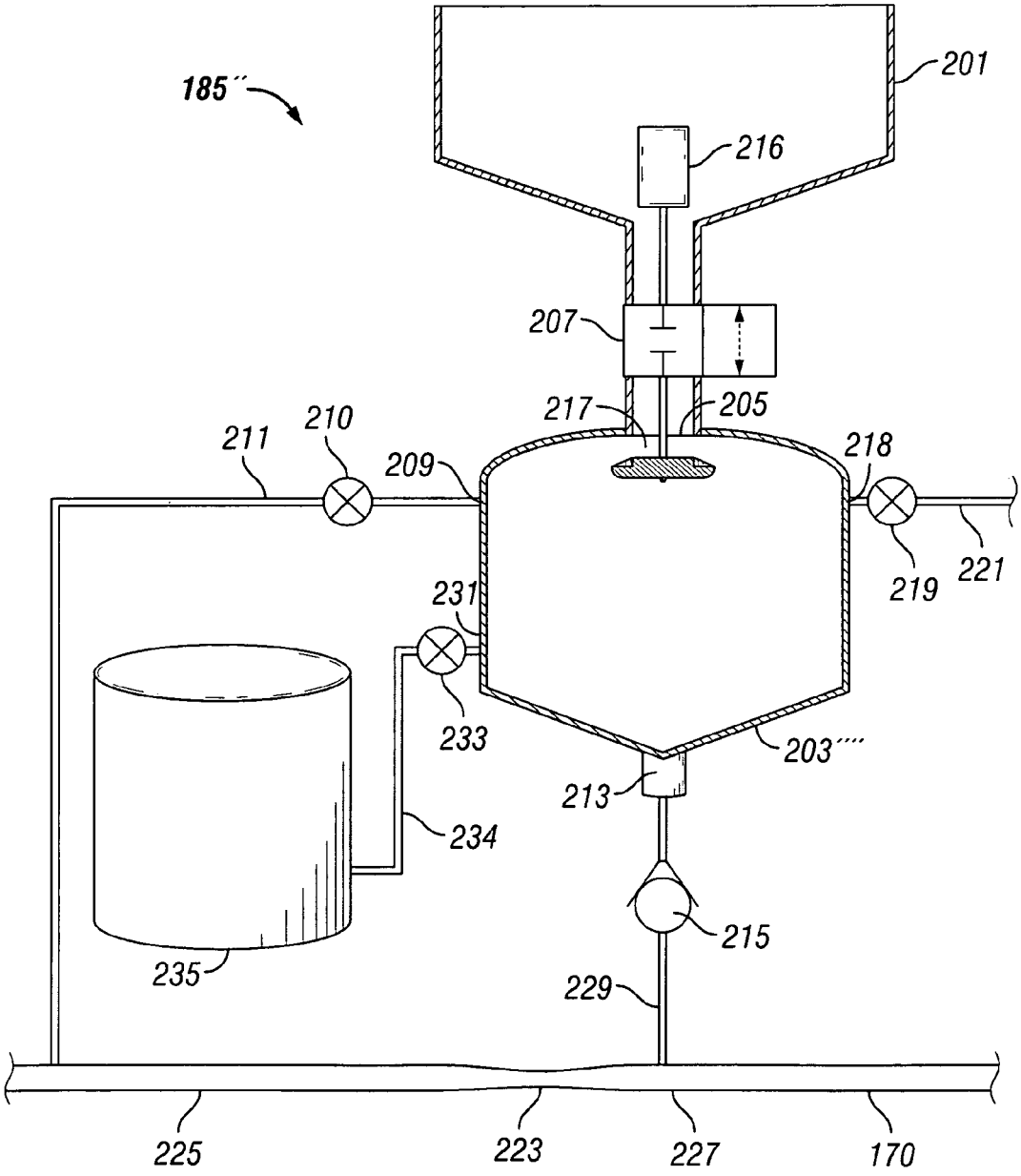
FIG. 12 is schematic diagram of an oilfield delivery mechanism subassembly used in an oilfield delivery mechanism as described in FIGS. 1 through 11 with the addition of a port allowing introduction of an additive to the flow in a high-pressure fluid line.

FIG. 12 is a schematic illustration in which the oilfield material delivery mechanism 175 has been extended to provide additives to the fluid mixture in the pressure vessel 203. There are many types of additives that may be added to treatment fluids. These include coating materials for coating the oilfield material 275 delivered from the reservoir 201, viscosity breakers (e.g., oxidizers and enzymes, common oxidative breakers are the ammonium, potassium and sodium salts of peroxydisulfate), friction reducing agents (e.g., hydrolyzed acrylamide, grease and lubricating oil), cross-linkers (e.g., Titanium, Zirconium, Aluminum, Antimony, inorganic species such as borate salts and transition-metal complexes, Boric acid), cross-link delaying agents (e.g., Ligands—triethanolamine, acetylacetone, ammonium lactate), lubricants (e.g., grease, and gelled fluid), fiber (e.g., silica), explosive chemicals (e.g., hydrogen peroxide, RDX, HMX, PETN, PBX), bonding agents and adhesives (e.g., resin, curable epoxies), and/or combinations thereof, as will be appreciated by those skilled in the art. Some of the additive materials listed hereinabove act as coating materials for the oilfield material with excess of the additive suspended in the fracturing fluid.

While the additives may not necessarily be directly related to enhance the properties of the oilfield material 275, e.g., where the oilfield material 275 is a proppant, the oilfield material 275 may act as a carrier of the additive and retain the additive in the fractures 210. Specially such would be the case when the oilfield material grain surface has an affinity to bond with the additives that are to be transported to the reservoir. In this case the additive also behaves as a coating to the oilfield material 275.

Continuing now with FIG. 12, in addition to the inlets, outlets, and apertures and ancillary valves described hereinabove in conjunction with pressure vessels 203, 203', 203", and 203'", the pressure vessel 203"" includes an additive inlet port 231 with an accompanying high-pressure valve (additive inlet valve) 233 connected to an additive source 235 via an additive carrying line 234. During slurry release operations the additive inlet valve 233 is closed.

With the subassembly for introducing an oilfield chemical 185"", the Stage 1: refill operation may include the substeps of introducing oilfield chemical 275 from the reservoir 201 and the substep of introducing additive from the additive source 235. These substeps may be combined in any combination, e.g., in one operating cycle the substep of introducing oilfield material 275 may be omitted and in the Stage 2: release phase only additive is discharged into the fluid line 170. In another operation cycle only oilfield material 275 may be introduced into the pressure vessel 203"" thereby providing a slug of oilfield material without the additive.

Alternatively, the additive is added during the release Stage 2. In that alternative the additive inlet valve 233 is closed during the refill stage and opened in conjunction with the high-pressure inlet valve 210. In some manner, for example with a triplex pump, the additive stream is pressurized to a level equivalent to the pressure in the pressure vessel 203 to allow flow of additive into the pressurized pressure vessel 203.

The subassemblies 185"" are preferably aggregated into assemblies of multiple subassemblies as discussed hereinabove in conjunction with FIGS. 1 through 11. The subassemblies 185"" are then cycled in a coordinated fashion to introduce a near-continuous flow of oilfield material combined with the additive.

Figure 13:
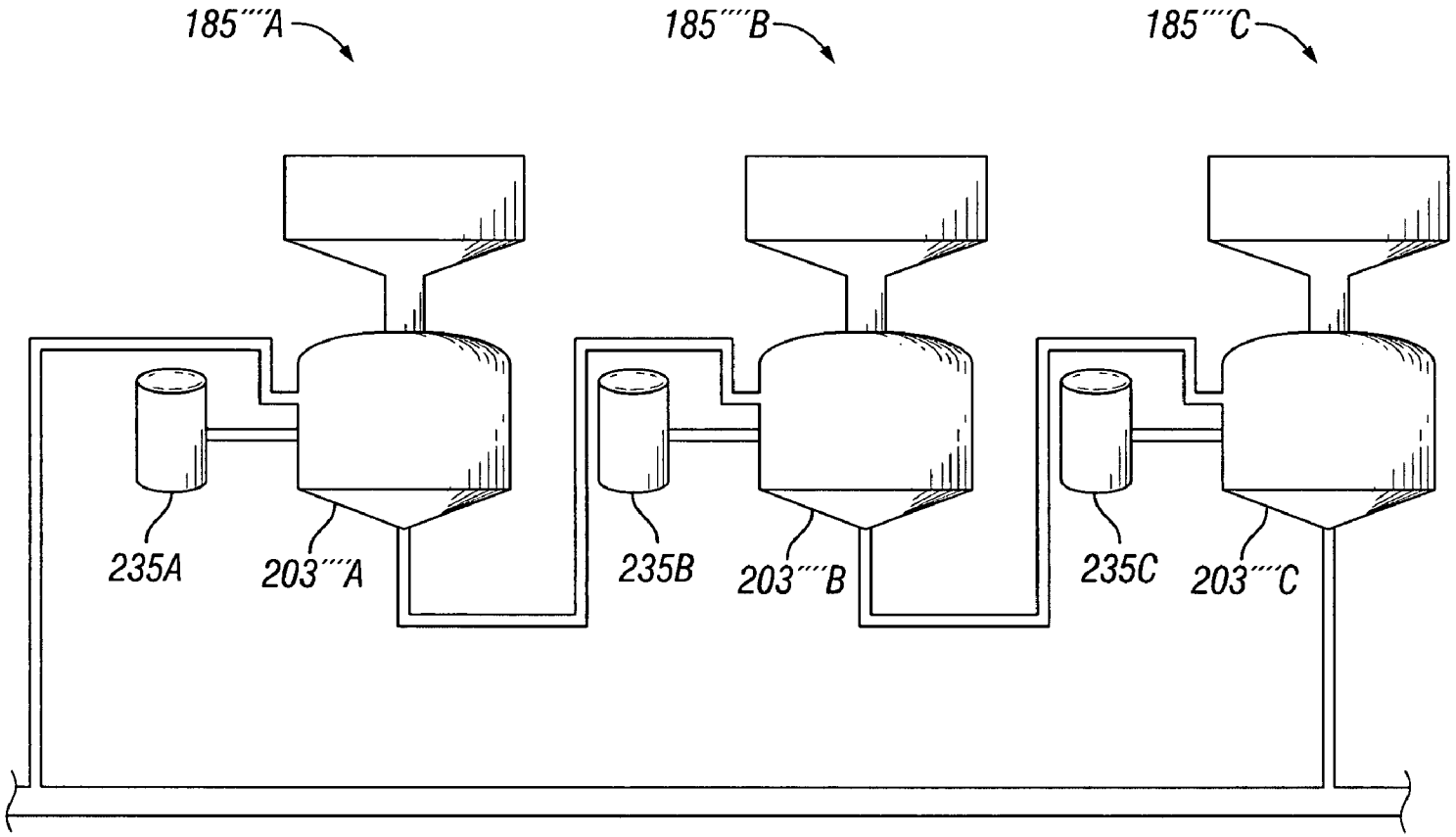
FIG. 13 is a schematic diagram of an aggregation of oilfield delivery mechanisms in the manner of FIG. 12 wherein the aggregation allows for introduction of combinations of additives into the high-pressure fluid line.

In an embodiment, illustrated in a simplified form in FIG. 13, several subassemblies 185"" for introducing additive combined with an oilfield material into a high-pressure stream may be connected in sequence to introduce multiple additives to the stream. As in the previous examples the high-pressure flow from the fluid line 170 is diverted into the pressure vessel 203""*a*. In pressure vessel 203""*a* a first additive is added to the stream in the manner explained hereinabove from the first additive source 235*a*. The output released from the first pressure vessel 203""*a* is then routed into the second pressure vessel 203""*b* where it is combined with a second additive from the second additive source 235*b* and the output from the second pressure vessel 203""*b* is fed into the third pressure vessel 203""*c*. A third additive is added to the stream from the third additive source 235*c*. Finally, the output released from the third pressure vessel 203""*c* is introduced into the fluid line 170 in the manner described hereinabove.

In an embodiment each output stream is added directly to the fluid line 170 without being pumped through other pressure vessels 203"".

By combining an additive, e.g., a coating, to the fluid flow on the high-pressure side the coating is not subjected to the wear produced by the pressure inducing equipment. This process thus allows for additives that would not fare well when exposed to the harsh handling that high-pressure pumps impose on the fluid pumped there through. Conversely, to the extent that the additives are harmful to the pumps, the pumps are not thus exposed and that wear is avoided.

Turning now to FIG. 14, with added reference to FIG. 1, an overview of the above-described oilfield material delivery mechanism 100 in operation at an oilfield 301 is shown. In the embodiment shown, the oilfield material delivery mechanism 100 is employed in a fracturing operation at the oilfield 301. The pressure inducing equipment 150 of FIG. 1 is a part of a larger pressure inducing assembly 375 including a host of pumps atop the skid 159 (See FIG. 1). A high-pressure fluid flow 210 as detailed above with reference to FIGS. 1 through 12, may thereby be generated and directed toward the material supply equipment 175. Pumps may be located downstream of the pressure inducing assembly 375 and/or adjacent the material supply equipment 175 for providing flow to the material supply equipment 175 and/or the choke 223, as will be appreciated by those skilled in the art.

Material supply equipment 175 may operate to introduce oilfield material 275 such as proppant into the fluid flow 210 on the high-pressure side of the pressure inducing assembly 375. The fluid flow 210 is directed past a well head 310 into a well 320 drilled into the oilfield 301. The well 320 may traverse a fracturable production region 330 of the oilfield 301. The delivery of high-pressure fluid flow may thereby be employed to promote the production of hydrocarbons from the production region 330. That is, as detailed above, the fluid flow 210 may include oilfield material 275 in the form of an abrasive proppant to encourage the fracturing of geologic formations below the oilfield 301 to enhance the noted hydrocarbon production.

The oilfield material delivery mechanism 100, the subassembly 185 or group of subassemblies 185, 185', 185", 185''', 185'''', and the fill stages 801*a*, 801*b*, the discharge stages 809*a*, 809*b*, described hereinabove may be operated to create a heterogeneous (i.e. non-homogenous or non-continuous) slurry flow operation, wherein alternating flow of slurry and clean fluid (such as the slurry 603 and the fluid 601) is supplied to the wellbore 320, thereby enabling heterogeneous placement of the slurry 603 and the oilfield material 275 in the wellbore 320, as will be appreciated by those skilled in the art. Heterogeneous placement of oilfield material 275, such as proppant and the like, may be advantageous for the creation of highly conductive fractures in the formation 303 and/or the production region 330, as recited in U.S. Pat. Nos. 6,776,235 and 7,451,812, and commonly assigned and co-pending application Ser. No. 11/608,686, the disclosures of each of which are incorporated by reference herein in their entireties.

The operation of the oilfield material delivery mechanism 100, the subassemblies 185, 185', 185", 185''', 185'''', and the fill stages 801*a*, 801*b*, the discharge stages 809*a*, 809*b* may be varied to produce heterogeneous flow of slurry 603 having a desired density concentration in the wellbore 320, to produce a flow of slurry 603 entering the wellhead 310 at predetermined intervals and/or for a predetermined duration. In a non-limiting example, a flow of slurry 603 at the wellhead 310 may range from a density of about 0.1 to about 16.0 ppg (pounds of proppant per gallon) and may flow at a predetermined time for about one second to about two minutes in duration and at intervals from about one second to about two minutes. In the intervals between the flow of slurry 603 at the wellhead 310, clean liquid or fluid 601 flows to the wellhead 310 or slurry 603 having a density of less than 0.1 ppg flows to the wellhead 310. Heterogeneous proppant placement may be advantageous for a fracturing method such as, but not limited to, introducing a one of a slurry and proppant-laden slurry into a wellbore 320 for a predetermined period of time.

In a non-limiting example, a method of operating for heterogeneous placement of oilfield material may comprise alternating fluid flows having a contrast in their respective properties in order to stimulate the subterranean formation penetrated by a wellbore. The contrast in properties may include, but is not limited to, fluids having different densities, fluids having a difference in the size of proppant utilized, and/or fluids having a difference in the concentration of the fluids, such as the concentration of the oilfield material in the treatment fluids.

In a non-limiting example, a method of operating for heterogeneous placement of oilfield material may comprise designing an initial model such as a fracturing model, operating the equipment (such as the oilfield material delivery mechanism 100, the subassemblies 185, 185', 185", 185''', 185'''') to effect the model, and altering the operation of the equipment based on operating data acquired from the equipment and/or from the wellbore 320.

In a non-limiting example, a method of operating for heterogeneous placement of oilfield material may comprise the oilfield material of the treatment fluid may comprise a proppant and channel-forming fill material including, but not limited to, fibers or particles, dissolvable, or degradable, or combinations thereof, that act as a fill during the creation of fractures in the formation but may be subsequently removed to create channels in the formation to promote production of the fluid of interest from the wellbore 320.

In a non-limiting example, rather than alternating flows of slurry and clean fluid, the heterogeneous flow operation may be operated to create alternating flows of high density (i.e. proppant rich) slurry and low density (i.e. proppant lean) slurry, depending on the requirements of the operation, as will be appreciated by those skilled in the art.

As opposed to merely monitoring some degree of damage to pressure inducing equipment, the herein described oilfield material delivery mechanism and method of operation thereof avoids of the harmful effects that result from pumping abrasive slurries through the pressure inducing equipment. The reduced wear on the pressure inducing equipment prolongs the life of these components, minimizes maintenance costs and down-time. Furthermore, the herein described embodiments are fully scalable and provide an elegant solution that require only relatively simple equipment, and yet provide a great deal of flexibility in the introduction of oilfield material and additives to a high-pressure fluid flow.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about A to about B," or, equivalently, "from approximately A to B," or, equivalently, "from approximately A-B") disclosed herein is to be understood as referring to the power set (the set of all subsets) of the respective range of values. Accordingly, the protection sought herein is as set forth in the claims below.

We claim:

1. A method of operating at least one pressure vessel to inject a particulate slurry into a high-pressure line, comprising:

a first operating cycle comprising:

isolating the at least one pressure vessel from the high-pressure line;

introducing particulate solids into the pressure vessel through a particulate solids inlet aperture;

a second operating cycle comprising:

providing high-pressure flow into the pressure vessel; and providing a high-pressure slurry flow from the pressure vessel into the high-pressure line;

operating the at least one pressure vessel in the second operating cycle to create a heterogeneous flow of slurry into the high-pressure line;

wherein the at least one pressure vessel is a single chamber container, and wherein the second operating cycle further comprises equalizing the pressure of the pressure vessel and the high-pressure line by increasing the pressure in the pressure vessel prior to providing high-pressure clean-fluid flow into the pressure vessel.

2. The method of claim 1 wherein operating comprises alternately operating the at least one pressure vessel in the first operating cycle and the second operating cycle.

3. The method of claim 1 wherein the fluid in the high pressure line and the high pressure slurry flow comprise contrasting properties.

4. The method of claim 1 wherein the particulate slurry comprises at least one of a proppant, a proppant coating, and fill material.

5. The method of claim 1 wherein the high pressure line comprises substantially clean treatment fluid.

6. The method of claim 1 wherein the at least one pressure vessel comprises at least two pressure vessels.

7. The method of claim 6 further comprising causing one pressure vessel to operate in the first operating cycle while operating the other pressure vessel in the second operating cycle.

8. The method of claim 6 further comprising switching a first pressure vessel from the first operating cycle to the second operating cycle and switching a second pressure vessel from the second operating cycle to the first operating cycle, and synchronizing the switching in a manner such that the at least two pressure vessels are operating in the second operating cycle simultaneously.

9. The method of claim 6 wherein the at least two pressure vessels is at least four pressure vessels organized in at least two phased pairs wherein at least one pair of pressure vessels switch between first and second operating cycles at a time that is different from when at least one other pair switch between first and second operating cycles.

10. A method of operating at least one pressure vessel to inject a particulate slurry into a high-pressure line, the high pressure line comprising substantially clean treatment fluid, the method comprising:

a first operating cycle comprising:

isolating the at least one pressure vessel from the high-pressure line;

introducing, under low-pressure conditions, particulate solids into the pressure vessel through a particulate solids inlet aperture;

a second operating cycle comprising:

providing high-pressure flow into the pressure vessel; and providing a high-pressure slurry flow from the pressure vessel into the high-pressure line;

operating the at least one pressure vessel in the second operating cycle for a predetermined time interval to create heterogeneous flow of slurry into the high-pressure line;

wherein the at least one pressure vessel is a single chamber container, and wherein the second operating cycle further comprises equalizing the pressure of the pressure vessel and the high-pressure line by increasing the pressure in the pressure vessel prior to providing high-pressure clean-fluid flow into the pressure vessel.

11. The method of claim 10 wherein the predetermined time interval comprises operating the at least one pressure vessel in the second operating cycle for a predetermined duration of time.

12. The method of claim 11 wherein the predetermined duration comprises from about one second to about two minutes.

13. The method of claim 11 further comprising stopping the second operating cycle for a second predetermined duration of time.

14. The method of claim 13 wherein the second predetermined duration of time comprises from about one second to about two minutes.

15. The method of claim 13 wherein the first predetermined time interval comprises from about one second to about two minutes and wherein the second predetermined time interval comprises from about one second to about two minutes.

16. The method of claim 13 wherein the high pressure line supplies treatment fluid to the wellbore during the second predetermined time interval.

17. The method of claim 10 wherein the predetermined time interval comprises operating the at least one pressure vessel in the second operating cycle for a first predetermined duration of time and operating the at least one pressure vessel in the first operating cycle for a second predetermined duration of time.

18. The method of claim 10 wherein operating comprises operating the at least one pressure vessel to produce slurry at the predetermined time intervals of a predetermined density in the high pressure line.

19. The method of claim 18 wherein the predetermined density is about 0.1 pounds of proppant per gallon to about 16.0 pounds of proppant per gallon.

20. The method of claim 10 wherein the second operating cycle comprises:

causing the pressure of the pressure vessel to slightly exceed the pressure of the high-pressure line thereby producing the high-pressure slurry flow from the pressure vessel into the high-pressure line.

21. A method of fracturing a subterranean formation penetrated by a wellbore utilizing at least one pressure vessel to inject a particulate slurry into a high-pressure line, the high-pressure line comprising substantially clean treatment fluid, comprising:

isolating the at least one pressure vessel from the high-pressure line;

introducing, under low-pressure conditions, particulate solids into the pressure vessel through a particulate solids inlet aperture to form the slurry, the slurry having a predetermined property different than a property of the treatment fluid;

providing high-pressure flow into the pressure vessel;

providing a high-pressure slurry flow from the pressure vessel into the high-pressure line to inject the slurry into the high pressure line at a predetermined time interval to create heterogeneous flow of slurry into the high-pressure line;

equalizing the pressure of the pressure vessel and the high-pressure line by increasing the pressure in the pressure vessel prior to providing high-pressure clean-fluid flow into the pressure vessel; and routing the high pressure line to the wellbore to perform a fracturing job in the wellbore;

wherein the at least one pressure vessel is a single chamber container.

* * * * *